US008236471B2

(12) United States Patent
Takagi et al.

(10) Patent No.: US 8,236,471 B2
(45) Date of Patent: Aug. 7, 2012

(54) TONER FOR DEVELOPING ELECTROSTATIC CHARGE IMAGE, DEVELOPER FOR DEVELOPING AN ELECTROSTATIC CHARGE IMAGE, TONER CARTRIDGE, PROCESS CARTRIDGE, AND IMAGE FORMING APPARATUS

(75) Inventors: Shinpei Takagi, Kanagawa (JP); Satoshi Yoshida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 503 days.

(21) Appl. No.: 12/430,489

(22) Filed: Apr. 27, 2009

(65) Prior Publication Data

US 2010/0159381 A1 Jun. 24, 2010

(30) Foreign Application Priority Data

Dec. 22, 2008 (JP) ..... 2008-325876

(51) Int. Cl.
*G03G 9/00* (2006.01)

(52) U.S. Cl. ..... 430/109.4; 430/108.1; 430/108.8; 430/109.1

(58) Field of Classification Search ..... 430/108.1, 430/108.8, 109.1, 109.4
See application file for complete search history.

(56) References Cited

U.S. PATENT DOCUMENTS

| | | | |
|---|---|---|---|
| 3,853,778 | A | 12/1974 | Buckley et al. |
| 5,547,794 | A | 8/1996 | Demizu et al. |
| 2003/0124448 | A1 | 7/2003 | Shinzo et al. |
| 2004/0142264 | A1 | 7/2004 | Tanaka et al. |
| 2005/0196693 | A1 | 9/2005 | Ohmura et al. |
| 2008/0107991 | A1 | 5/2008 | Hamano |

FOREIGN PATENT DOCUMENTS

| | | |
|---|---|---|
| CN | A-101174112 | 5/2008 |
| JP | B2-56-13943 | 4/1981 |
| JP | A-7-325429 | 12/1995 |
| JP | A-2000-250256 | 9/2000 |
| JP | A-2002-351139 | 12/2002 |
| JP | A-2003-50478 | 2/2003 |
| JP | A-2003-231757 | 8/2003 |
| JP | A-2004-177554 | 6/2004 |
| JP | A-2004-206081 | 7/2004 |

(Continued)

OTHER PUBLICATIONS

Machine Translation of JP-A-2006-276064, Published Oct. 12, 2006.*

(Continued)

*Primary Examiner* — Mark F Huff
*Assistant Examiner* — Stewart Fraser
(74) *Attorney, Agent, or Firm* — Oliff & Berridge, PLC

(57) ABSTRACT

A toner for developing an electrostatic charge image, the toner including a binder resin containing a crystalline polyester resin and a noncrystalline polyester resin, a colorant, a releasing agent, a ketone solvent, and an alcoholic solvent, the total concentration of the ketone solvent and the alcoholic solvent in the toner dispersion liquid being less than about 10 ppm when 0.5 g of the toner is dispersed in 2 g of deionized water to form a toner dispersion liquid, and the total concentration of the ketone solvent and the alcoholic solvent in the toner dispersion liquid being from about 2 ppm to about 50 ppm when 0.5 g of the toner is dispersed in 2 g of N,N-dimethylformamide to form a toner dispersion liquid.

10 Claims, 2 Drawing Sheets

FOREIGN PATENT DOCUMENTS

| | | | |
|---|---|---|---|
| JP | A-2004-287426 | | 10/2004 |
| JP | A-2005-321595 | | 11/2005 |
| JP | 2006276064 A | * | 10/2006 |
| JP | A-2006-276064 | | 10/2006 |
| JP | A-2008-40285 | | 2/2008 |
| JP | A-2008-116568 | | 5/2008 |

OTHER PUBLICATIONS

Office Action issued in Japanese Patent Application No. 2008-325876, dated Dec. 21, 2010 (with translation).
Office Action dated Mar. 6, 2012 issued in Chinese Patent Application No. 200910141287.9 (with translation).

* cited by examiner

TONER FOR DEVELOPING ELECTROSTATIC CHARGE IMAGE, DEVELOPER FOR DEVELOPING AN ELECTROSTATIC CHARGE IMAGE, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2008-325876 filed on Dec. 22, 2008.

BACKGROUND

1. Technical Field

The present invention relates to a toner for developing an electrostatic latent image, a developer for developing an electrostatic charge image, a toner cartridge, a process cartridge, and an image forming apparatus.

2. Related Art

Many electrophotographic processes are known. For example, in an electrophotographic process, a latent image is electrically formed on a photoreceptor containing a photoconductive material using any of various methods. The latent image is developed with a toner, and the toner image on the photoreceptor is transferred, directly or via an intermediate transfer member, to an image-receiving film such as paper. The transferred image is fixed by application of, for example, heat, pressure, heat and pressure, or a solvent vapor. A fixed image is formed through the plural steps described above. Toner remaining on the photoreceptor is cleaned as necessary using any of various methods, and the cycle including the above-described steps is repeated.

SUMMARY

According to an aspect of the present invention, there is provided a toner for developing an electrostatic charge image, the toner including a binder resin containing a crystalline polyester resin and a noncrystalline polyester resin, a colorant, a releasing agent, a ketone solvent, and an alcoholic solvent, the total concentration of the ketone solvent and the alcoholic solvent in the toner dispersion liquid being less than about 10 ppm when 0.5 g of the toner is dispersed in 2 g of deionized water to form a toner dispersion liquid, and the total concentration of the ketone solvent and the alcoholic solvent in the toner dispersion liquid being from about 2 ppm to about 50 ppm when 0.5 g of the toner is dispersed in 2 g of N,N-dimethylformamide to form a toner dispersion liquid.

BRIEF DESCRIPTION OF THE DRAWING

Exemplary embodiments of the present invention will be described in detail based on the following figures, wherein.

DETAILED DESCRIPTION

Toner for Developing Electrostatic Charge Image

Figure 1:
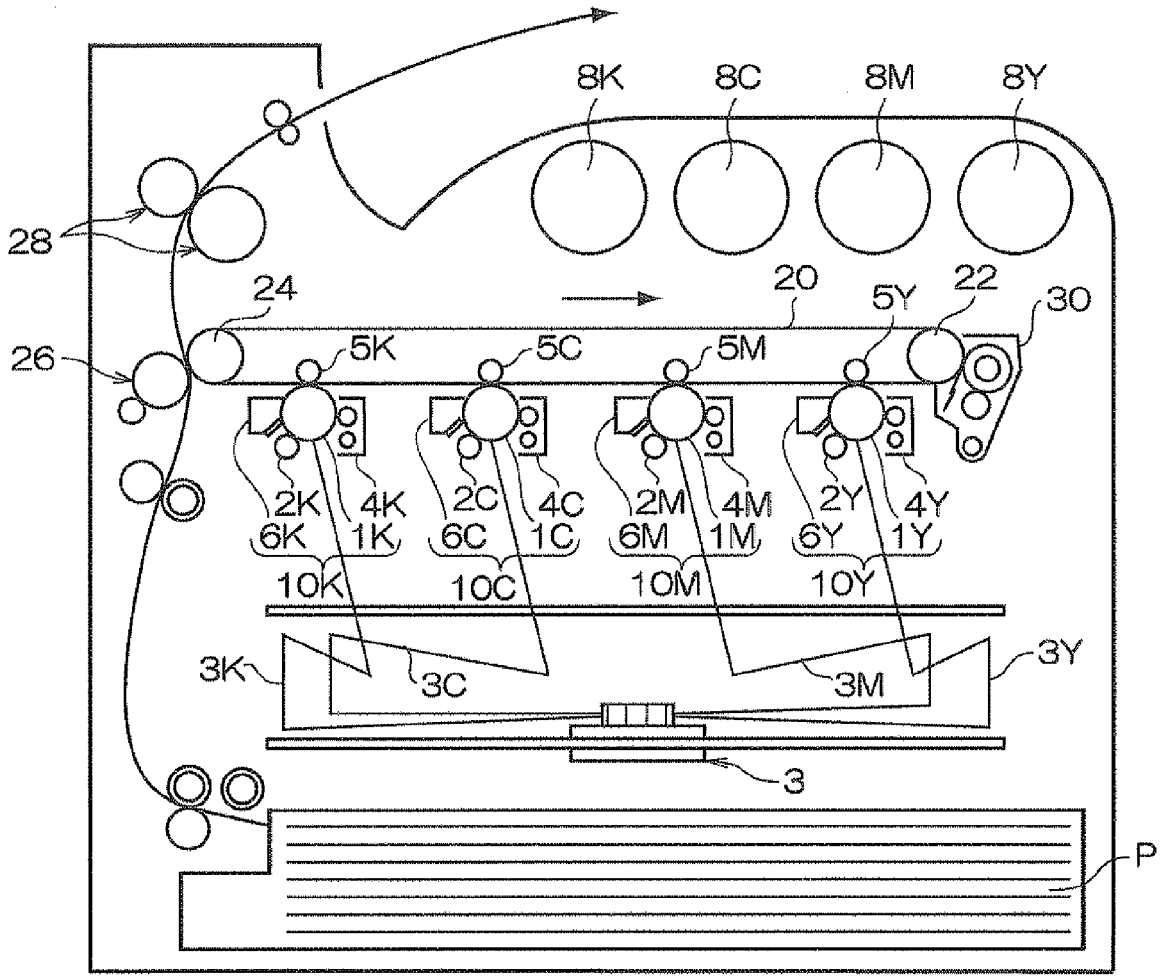
FIG. 1 is a schematic structural diagram illustrating an example of an image-forming apparatus according to an exemplary embodiment.

The toner for developing an electrostatic charge image of the present exemplary embodiment (hereinafter sometimes referred to as "toner of the present exemplary embodiment") includes a binder resin containing a crystalline polyester resin and a noncrystalline polyester resin, a colorant, a releasing agent, a ketone solvent, and an alcoholic solvent. When 0.5 g of the toner is dispersed in 2 g of deionized water to form a toner dispersion liquid, the total concentration of the ketone solvent and the alcoholic solvent in the toner dispersion liquid is less than 10 ppm (or less than about 10 ppm). When 0.5 g of the toner is dispersed in 2 g of N,N-dimethylformamide to form a toner dispersion liquid, the total concentration of the ketone solvent and the alcoholic solvent in the toner dispersion liquid is from 2 ppm to 50 ppm (or from about 2 ppm to about 50 ppm).

When the toner of the present exemplary embodiment is used, fixing properties, such as foldability of a fixed image (foldability as used herein referring to comparative absence of image defects generated when a recorded medium is folded), may be less influenced by the fixing speed, toner blocking may not occur, and the toner may have excellent storability at high temperatures. The mechanism by which such effects are obtained is presumed to be as follows.

The foldability of a fixed image is thought to depend on the penetration of the toner into a recording medium such as recording paper and the adhesiveness between the toner and the recording medium. The influence of the fixing speed on the fixing properties results from a variation in the amount of heat supplied to the toner at the time of fixing. Since the toner forming an image is fixed by contacting the toner with a heating member such as a fuser roller, a higher heating temperature or a longer heating time facilitates infiltration of the toner into a recording medium such as recording paper.

Therefore, the degree of infiltration of the toner into the recording medium varies with the heating time, so that the foldability is influenced by the fixing speed.

In order to reduce the influence of the fixing speed, it is important to enable the toner to infiltrate into the recording medium with a reduced heat amount, and to provide superior adhesiveness between the toner and the recording medium. As a result of a study of infiltration of toner into the recording medium with less heat and provision of excellent adhesiveness between toner and a recording medium, the present inventors have found that infiltration of the toner into the recording medium with less heat and excellent adhesiveness between the toner and the recording medium can be realized by including a ketone solvent and an alcoholic solvent in the toner.

Such improvements are thought to result from the mechanisms as described below. The presence of the ketone solvent improves the miscibility of the crystalline polyester resin and the noncrystalline polyester resin at an interface therebetween, so that the binder resin is plasticized and the toner infiltrates into a recording medium, such as recording paper, with a reduced heat amount for fixing.

The alcoholic solvent as a component in the toner is evaporated by the heat supplied at the time of fixing, or penetrates, together with the toner, into the space between fibers (for example, cellulose fibers) constituting the recording paper. Cellulose, which is a plant-based fiber, has many hydroxyl groups, which are hydrophilic groups. The hydroxyl groups of cellulose form strong hydrogen bonds with hydroxyl groups of the alcoholic solvent, so that the adhesion between the toner and the recording paper can be strengthened. As a result, when the recording medium is folded at a fixed image portion, image defects are less likely to occur, and the foldability of an image is less affected by the fixing speed. The improvements are thought to be obtained through the above mechanisms.

However, while the alcoholic solvent has high hydrophilicity, it has only a low solubility in the polyester resins used as a binder resin. In a wet production method in which toner particles are produced in a water medium, therefore, it is difficult to incorporate the alcoholic solvent into the toner particles, and the advantageous effects described above are hard to obtain. In the present exemplary embodiment, the alcoholic solvent is used together with a ketone solvent having high solubility in the alcoholic solvent and high solubility in the polyester resins; therefore, the alcoholic solvent can be incorporated into the toner particles.

In order to include the ketone solvent and the alcoholic solvent in the toner, the following method may be used, for example. First, a neutralizing agent and an aqueous medium are added to a resin solution in which a crystalline polyester resin and a noncrystalline polyester resin are dissolved in a mixed solvent of a ketone solvent and an alcoholic solvent, thereby causing phase inversion and forming a dispersion liquid containing emulsified particles. Thereafter, the amount of the ketone solvent and the absolute amount of the alcoholic solvent in the emulsified particle dispersion liquid are regulated by controlling the conditions for distilling off the solvents. Then, the emulsified particle dispersion liquid is subjected to an aggregation and coalescence process, thereby forming toner particles. Then, the obtained toner particle dispersion liquid is washed and dried. The amounts of the ketone solvent and the alcoholic solvent extracted by each of the different solvents can be regulated by appropriately setting the drying conditions.

Another method utilizes a greater tendency for the solvents to remain in the toner, which is realized by including a crystalline polyester resin in the toner. The polyester resin is a polycondensation resin of a dicarboxylic acid monomer and a dialcohol monomer, and the molecular structure thereof, including the generated ester bonds, is similar to those of the ketone solvent and the alcoholic solvent. Therefore, the polyester resin has high compatibility with the ketone solvent and the alcoholic solvent. Since the crystalline polyester resin has crystallinity, the crystalline resin has hardly any steric hindrance, and the ester bonds therein are not shielded. As a result, the crystalline polyester resin interacts with the solvents easily. The use of the crystalline polyester resin in the toner increases the tendency for the solvents to remain in the toner due to the effects described above.

Although it is preferable for the toner to contain both a ketone solvent and an alcoholic solvent from the viewpoint of obtaining foldability of an image as described above, the presence of the ketone solvent having high solubility in the polyester resin on the toner particle surface results in plasticization of the binder resin, whereby the stickiness of the toner may deteriorate anti-cohesion properties and storability at high temperatures of the toner and/or environmental problems may be produced such as emission of VOC components from the toner surface. Accordingly, the presence of the ketone solvent and the alcohol solvent at the toner surface is preferably avoided as far as possible, and the ketone solvent and the alcoholic solvent should be present only in the interior portion of the toner particle.

In the present exemplary embodiment, the total amount of the ketone solvent and the alcoholic solvent extracted by water when dispersing the toner particles in a water medium is regulated to a small amount. The amount observed when the toner particles are dispersed in an aqueous medium is considered to be indicative of the total amount of the ketone solvent and the alcoholic solvent present at the surfaces of the toner particles. Further, the total amount of the ketone solvent and the alcoholic solvent extracted by dissolving the toner particles in DMF (N,N-dimethylformamide) is regulated to fall within a specified range. The amount observed when the toner particles are dissolved in DMF is considered to be indicative of the total amount of the ketone solvent and the alcoholic solvent contained in the toner particles. By appropriately controlling the total amount of the ketone solvent and the alcoholic solvent contained in the toner particles, it is possible to simultaneously achieve excellent fixing properties (decreased influence of the fixing speed on the foldability), anti-cohesion properties of the toner, and storability at high temperatures.

As described above, the toner of the present exemplary embodiment includes a ketone solvent and an alcoholic solvent, as a result of which occurrence of defects in an image is suppressed even when the recording medium is folded at a fixed image area, and the foldability of the image is less influenced by the fixing speed. These effects are produced when the total concentration of the ketone solvent and the alcohol solvent in a toner dispersion liquid obtained by dispersing 0.5 g of the toner in 2 g of N,N-dimethylformamide (DMF) is from 2 ppm to 50 ppm (or from about 2 ppm to about 50 ppm). Here, the concentration of the ketone solvent and the concentration of the alcohol solvent in the toner dispersion liquid refers to the concentration of the ketone solvent and the concentration of the alcoholic solvent in the supernatant liquid (hereinafter sometimes referred to as "DMF dissolution supernatant liquid") of the toner dispersion liquid that was prepared by dispersing 0.5 g of the toner in 2 g of N,N-dimethylformamide (DMF) and thereafter has been left to stand at 20° C. for 24 hours.

When 0.5 g of the toner is dispersed in 2 g of DMF, the toner dissolves and the concentrations of the ketone solvent and the alcoholic solvent in the DMF dissolution supernatant liquid are proportional to the concentrations of the ketone solvent and the alcoholic solvent, respectively, contained in the entire toner particle. The method for measuring the concentrations of the ketone solvent and the alcoholic solvent in the DMF dissolution supernatant liquid is described below.

The total concentration of the ketone solvent and the alcoholic solvent in the DMF dissolution supernatant liquid is preferably from 5 ppm to 40 ppm (or from about 5 ppm to about 40 ppm), and more preferably from 10 ppm to 35 ppm (or from about 10 ppm to about 35 ppm), from the viewpoint of obtaining stronger effects in that image defects generated by folding a recording medium at a fixed image area are suppressed and that the foldability of an image is less influenced by the fixing speed. When the total concentration of the ketone solvent and the alcoholic solvent is less than 2 ppm, the effects caused by evaporation at the time of fixing may not be obtained. When the total concentration of the ketone solvent and the alcoholic solvent is more than 50 ppm, the solvents may bleed onto the toner particle surface, and may cause adverse effects on surface stickiness and charging properties of the toner.

The amount of the ketone solvent in the DMF dissolution supernatant liquid is preferably from 1 ppm to 15 ppm (or from about 1 ppm to about 15 ppm), more preferably from 1 ppm to 10 ppm (or from about 1 ppm to about 10 ppm), and still more preferably from 1 ppm to 8 ppm (or from about 1 ppm to about 8 ppm). When the amount of the ketone solvent is less than 1 ppm, effects in enhancement of compatibility between the crystalline polyester resin and the noncrystalline polyester resin are not obtained in some cases. When the amount of the ketone solvent is more than 15 ppm, the ketone solvent may cause filming and/or stickiness of the toner due to, for example, bleeding onto the toner particle surface.

The amount of the alcoholic solvent in the DMF dissolution supernatant liquid is preferably from 1 ppm to 49 ppm (or from about 1 ppm to about 49 ppm), and more preferably from 5 ppm to 30 ppm (or from about 5 ppm to about 30 ppm). When the amount of the alcoholic solvent is less than 1 ppm, the effects in enhancing the adhesion between the toner and the cellulose fibers of recording paper may be small. When the amount of the alcoholic solvent is more than 49 ppm, the hygroscopicity may be deteriorated, which may result in decreased charging properties.

The effects of providing excellent anti-cohesion properties of the toner and excellent storability at high temperatures are obtained when the total concentration of the ketone solvent and the alcoholic solvent in the toner dispersion liquid obtained by dispersing 0.5 g of the toner in 2 g of deionized water is less than 10 ppm (or less than about 10 ppm). Here, the concentration of the ketone solvent and the concentration of the alcoholic solvent in the toner dispersion liquid refer to the concentration of the ketone solvent and the concentration of the alcoholic solvent in the supernatant liquid (hereinafter sometimes referred to as "water dispersion supernatant liquid") of the toner dispersion liquid that was prepared by dispersing 0.5 g of the toner in 2 g of deionized water and thereafter has been left to stand at 20° C. for 24 hours.

When 0.5 g of the toner is dissolved in 2 g of deionized water, the ketone solvent and the alcoholic solvent at the toner surface disperse into the deionized water. The concentrations of the ketone solvent and the alcoholic solvent in the water dispersion supernatant liquid are proportional to the amount of the ketone solvent and the amount of the alcoholic solvent, respectively, present at the toner surface. The method for measuring the concentrations of the ketone solvent and the alcoholic solvent in the water dispersion supernatant liquid is described below.

The total concentration of the ketone solvent and the alcoholic solvent in the water dispersion supernatant liquid is preferably 5 ppm or less (or about 5 ppm or less), and more preferably 2 ppm or less (or about 2 ppm or less). When the total concentration of the ketone solvent and the alcoholic solvent in the water dispersion supernatant liquid is 10 ppm or more, the toner surface may become sticky, the toner cohesion properties may be deteriorated, and the storability at high temperatures may also be deteriorated. Further, the volatile components may emit odor, and the solvents may pollute mechanical components such as a toner cartridge and a developing device.

The ketone solvent used in the present exemplary embodiment is a solvent having a ketone group. The ketone solvent preferably has a boiling temperature of 100° C. or less (or about 100° C. or less), and more preferably 85° C. or less (or about 85° C. or less). Specific examples of the ketone solvent include acetone, methyl ethyl ketone, and diethyl ketone. Among them, methyl ethyl ketone is preferable in consideration of compatibility with the polyester resin, solubility in water, and boiling temperature. In regard to solvents other than ketones, for example, tetrahydrofuran (THF) has high solubility in water, and it is difficult to make THF remain in the toner. Toluene and xylene have such a low solubility in water that the particle size distribution may be deteriorated during a toner production process.

The alcoholic solvent used in the present exemplary embodiment is a solvent having an alcoholic group. The alcoholic solvent preferably has a boiling temperature of 100° C. or less (or about 100° C. or less), and more preferably 85° C. or less (or about 85° C. or less). Examples of the alcoholic solvent include methanol, ethanol, propanol, isopropanol, and butanol. Isopropanol (isopropyl alcohol) is preferable in consideration of its boiling temperature.

In the following, the method for measuring the concentrations of the ketone solvent and the alcoholic solvent in the water dispersion supernatant liquid and the method for measuring the concentrations of the ketone solvent and the alcoholic solvent in the DMF dissolution supernatant liquid are described.

(1) Measurement of Concentrations of Ketone Solvent and Alcoholic Solvent in Water Dispersion Supernatant Liquid (1-1) Preparation of Three-Point Calibration Curve Varied amounts (10 mg, 50 mg, and 100 mg) of methyl ethyl ketone (hereinafter abbreviated as MEK) are weighed and respectively added into 500 ml volumetric flasks. The liquid in each flask is diluted with deionized water to adjust the liquid volume to 500 ml, and this is used as a sample for drawing a calibration curve. Similarly, varied amounts (10 mg, 50 mg, and 100 mg) of isopropyl alcohol (hereinafter abbreviated as IPA) are weighed and respectively added into 500 ml volumetric flasks. The liquid in each flask is diluted with deionized water to adjust the liquid volume to 500 ml, and this is used as a sample for drawing a calibration curve.

A portion of each sample for drawing a calibration curve is taken out with a 2 ml one-mark pipette and is added into a vial bottle for a head space sampler, and the vial bottle is closed with a cap.

Measurement is performed under the following conditions for a head space sampler and a gas chromatograph. Based on the weight of the sample weighed at the time of preparing the sample for drawing a calibration curve, a calibration curve is drawn, taking the concentration (ppm) of MEK or IPA as the horizontal axis and the peak area thereof as the vertical axis, thereby providing a relational expression of a straight line that passes the origin.

(1-2) Measurement of Residual Solvent Amount 2 g of deionized water is added to 0.5 g of the toner to be measured, stirred for 10 minutes, and left to stand at 20° C. for 24 hours. The supernatant liquid thereof after the standing is used as a sample for measuring the residual solvent amount. A portion of the sample is extracted with a 2 ml one-mark pipette, and added into a vial bottle for a head space sampler. This sample is subjected to a measurement using gas chromatography under the following conditions, simultaneously with the samples for drawing a calibration curve described above.

Conditions of Head Space Sampler

Measurement instrument: Head space sampler HS-40 (trade name: manufactured by Perkin Elmer Inc.)

Oven temperatures 60° C.

Oven time: 15 minutes

Needle temperature: 100° C.

Transfer temperature: 120° C.

Conditions of Gas Chromatograph

Gas chromatograph main instrument: GC2010 (trade name: manufactured by Shimadzu Corporation)

Column: Capillary column S2010 (trade name: manufactured by Quadrex Corporation) having an inner diameter of 0.25 mm, a membrane thickness of 1 μm, and a length of 15 m Carrier gas: Nitrogen Injection temperature: 150° C.

Detector temperature: 200° C.

Column temperature: 55° C. for 5 minutes, and then increased to 200° C. at a temperature increase rate of 10° C./min.

Based on the respective peak areas of MEK and IPA obtained by the measurement of the measurement samples under the above-described conditions, the concentrations of MEK and IPA are obtained using the respective calibration curves (the above-described relational expressions).

(2) Measurement of Concentrations of Ketone Solvent and Alcoholic Solvent in DMF Dissolution Supernatant Liquid (2-1) Preparation of Three-Point Calibration Curve Varied amounts (10 mg, 50 mg, and 100 mg) of MEK are weighed and respectively added into 500 ml volumetric flasks. The liquid in each flask is diluted with N,N-dimethylformamide (hereinafter abbreviated as DMF) to adjust the liquid volume to 500 ml, and this is used as a sample for drawing a calibration curve. Similarly, varied amounts (10 mg, 50 mg, and 100 mg) of IPA are weighed and respectively added into 500 ml volumetric flasks. The liquid in each flask is diluted with DMF to adjust the liquid volume to 500 ml, and this is used as a sample for drawing a calibration curve.

A portion of each sample for drawing a calibration curve is extracted with a 2 ml one-mark pipette and is added into a vial bottle for a head space sampler, and the vial bottle is closed with a cap.

Measurement is performed under the following conditions for a head space sampler and a gas chromatography. Based on the weight of the sample weighed at the time of preparing the sample for drawing a calibration curve, a calibration curve is drawn, taking the concentration (ppm) of MEK or IPA as the horizontal axis and the peak area thereof as the vertical axis, thereby providing a relational expression of a straight line that passes the origin.

(2-2) Measurement of Residual Solvent Amount 2 g of DMF is added to 0.5 g of the toner, stirred for 10 minutes, and left to stand at 20° C. for 24 hours. The supernatant liquid thereof after the standing is used as a sample for measuring the residual solvent amount. A portion of the sample is extracted with a 2 ml one-mark pipette, and added into a vial bottle for a head space sampler. This sample is subjected to a measurement using gas chromatography under the following conditions, simultaneously with the samples for drawing a calibration curve described above.

Conditions of Head Space Sampler

Measurement instrument: Head space sampler HS-40 (trade name: manufactured by Perkin Elmer Inc.)

Oven temperature: 60° C.

Oven time: 15 minutes

Needle temperature: 100° C.

Transfer temperature: 120° C.

Conditions of Gas Chromatograph

Gas chromatograph main instrument: GC2010 (trade name: manufactured by Shimadzu Corporation)

Column: Capillary column S2010 (trade name: manufactured by Quadrex Corporation) having an inner diameter of 0.25 mm, a membrane thickness of 1 μm, and a length of 15 m Carrier gas: Nitrogen Injection temperature: 150° C.

Detector temperature: 200° C.

Column temperature: 55° C. for 5 minutes, and then increased to 200° C. at a temperature increase rate of 10° C./min.

Based on the respective peak areas of MEK and IPA obtained by the measurement of the measurement samples under the above-described conditions, the concentrations of the solvents are obtained using the respective calibration curves.

The measurement method is described above assuming that the ketone solvent is MEK and the alcoholic solvent is IPA. When the ketone solvent is a solvent other than MEK and/or the alcoholic solvent is a solvent other than IPA, a similar measurement may be performed using such other solvents.

In the following, each component included in the toner of the present exemplary embodiment is described.

The noncrystalline polyester resin in the binder resin used in the present exemplary embodiment is a polyester resin that does not show an endothermic peak corresponding to a crystal melting temperature in a differential scanning calorimetry (DSC) chart, other than an endothermic temperature corresponding to glass transition (Tg).

Monomers used for forming the noncrystalline polyester resin are not particularly limited, and may be, for example, a known divalent carboxylic acid or a tri- or higher-valent carboxylic acid, and a known dihydric alcohol or a tri- or higher-hydric alcohol, such as monomer components described in "Polymer Data Handbook: Basic Part" (edited by the Society of Polymer Science, Japan; published by Baifukan Co., Ltd.).

Specific examples of the monomer components include divalent carboxylic acids such as dibasic acids including succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid; anhydrides or lower alkyl esters thereof, and aliphatic unsaturated dicarboxylic acids including maleic acid, fumaric acid, itaconic acid, and citraconic acid. Examples of the tri- or higher-valent carboxylic acid include 1,2,4-benzene tricarboxylic acid, 1,2,5-benzene tricarboxylic acid, and 1,2,4-naphthalene tricarboxylic acid; and anhydrides or lower alkyl esters thereof. The carboxylic acid may be used singly, or in combination of two or more thereof.

Examples of the dihydric alcohol include bisphenol derivatives such as a hydrogenated bisphenol A and ethylene oxide and/or propylene oxide adducts of bisphenol A; cyclic aliphatic alcohols such as 1,4-cyclohexanediol and 1,4-cyclohexane dimethanol; linear diols such as ethylene glycol, diethylene glycol, propylene glycol, dipropylene glycol, 1,4-butanediol, 1,5-pentanediol, and 1,6-hexanediol; and branched diols such as 1,2-propanediol, 1,3-butanediol, neopentyl glycol, and 2,2-diethyl-1,3-propanediol. In consideration of charging properties or strength of the toner, the ethylene oxide and/or propylene oxide adducts of bisphenol A may mainly be used.

Examples of the tri- or higher-hydric alcohol include glycerin, trimethylolethane, trimethylolpropane, and pentaerythritol. In consideration of low-temperature fixability or image glossiness, the amount of the tri- or higher-hydric alcohol is preferably 10% by mol or less with respect to the total amount of the monomers. The tri- or higher-hydric alcohol may be used singly, or in combination two or more thereof. If necessary, for the purpose of adjusting the acid value or hydroxyl value, a monovalent acid such as acetic acid or benzoic acid, and/or a monohydric alcohol such as cyclohexanol or benzyl alcohol may also be used.

The noncrystalline polyester resin may be prepared from any combination of the above-described monomers by using known methods described, for example, in "Polycondensation" (published by Kagaku-dojin Publishing Company), "Experiments in Polymer Science—polycondensation and polyaddition" (published by Kyoritsu Shuppan Co., Ltd.), and "Polyester Resin Handbook" (edited by Nikkankogyo Shimbun Ed.). An ester exchange method or a direct polycondensation method may be used, and these methods may be used in combination. Specifically, the production of the noncrystalline polyester resin may be conducted at a polymerization temperature of from 140° C. to 270° C., and if necessary, the pressure within the reaction system is reduced and the reaction is conducted while removing water or alcohol generated in the condensation reaction.

When the monomer does not dissolve in or is not compatible with the solvent under the reaction temperature, a solvent having a high boiling temperature may be added as a solubilizing co-solvent to dissolve the monomer. The polycondensation reaction is conducted while distilling away the solubilizing co-solvent. When a monomer having low compatibility exists in the copolymerization reaction, the monomer having low compatibility may be previously condensed with an acid or alcohol to be polycondensed with the monomer, and then polycondensation reaction with main components may be conducted. The molar ratio of the acid component to the alcohol component (acid component/alcohol component) in the reaction varies depending on the reaction condition and the like, and is not limited to a particular value. When direct polycondensation of these components is conducted, the molar ratio of the acid component to the alcohol component (acid component/alcohol component) may be generally from 0.9/1 to 1/0.9. When an ester exchange reaction is used, an excess amount of a monomer removable by distillation under vacuum such as ethylene glycol, propylene glycol, neopentyl glycol, or cyclohexanedimethanol may be used.

Examples of a catalyst that can be used in noncrystalline polyester resin preparation include an alkali metal compound such as sodium or lithium; an alkali earth metal compound such as magnesium or calcium; a metal compound such as zinc, manganese, antimony, titanium, tin, zirconium, or germanium; a phosphite compound; a phosphate compound; and an amine compound. Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenyl phosphonium bromide, triethyl amine, and triphenyl amine. In the present exemplary embodiment, two or more kinds of catalysts may be used in combination. In consideration of charging properties of the toner, it is preferable to use a tin-containing catalyst such as dibutyltin oxide.

The acid value of the noncrystalline polyester resin is preferably from 5 to 25 KOHmg/g The hydroxyl value of the noncrystalline polyester resin is preferably from 5 to 40 KOHmg/g.

Measurements of the molecular weight and the molecular weight distribution may be conducted by the known methods, but gel permeation chromatography (hereinafter, simply referred to as "GPC") is generally used. Measurement of the molecular weight distribution is conducted under the following conditions. The GPC is conducted by using a GPC apparatus (trade names: HLC-8120GPC and SC-8020, manufactured by Tosoh Corporation), columns (6.0 mmID×15 cm×2) (trade names: TSK gel and Super HM-H, manufactured by Tosoh Corporation), and THF (tetrahydrofuran) for chromatography (manufactured by Wako Pure Chemical Industries, Ltd.) as an eluent. An experiment is conducted under the condition of a sample concentration: 0.5% by weight, a flow rate: 0.6 ml/min, a sample injection amount: 10 μl, and a measuring temperature: 40° C. The calibration curve is prepared using 10 samples: A-500, F-1, F-10, F-80, F-380, A-2500, F-4, F-40, F-128, and F-700. In the sample analysis, a data collection period is 300 ms.

The glass transition temperature of the noncrystalline polyester resin is obtained, for example, using a differential scanning calorimeter (trade name: DSC3110, manufactured by Mac Science Co., Ltd., thermal analysis system 001) (hereinafter, simply referred to as "DSC") by rising the temperature from 0° C. to 150° C. at a rate of 10° C./minute, holding the temperature at 150° C. for 5 minutes, decreasing the temperature from 150° C. to 0° C. using liquid nitrogen at a rate of −10° C./minute, holding the temperature at 0° C. for 5 minutes, and rising the temperature from 0° C. to 150° C. at a rate of 10° C./minute again. The glass transition temperature of the noncrystalline polyester resin may be defined as an onset temperature that is analyzed from an endothermic curve during second temperature rising. The glass transition temperature of the noncrystalline polyester resin is preferably from 40° C. to 80° C., and more preferably from 50° C. to 70° C. in consideration of balance of storage stability and toner fixability. When the glass transition temperature is less than about 40° C., the toner may cause blocking (toner particles cohere to form aggregates) during storage or within the developing unit. When the glass transition temperature exceeds 80° C., the fixing temperature of the toner may be increased.

When a temperature at which the loss elastic modulus G" (measuring frequency: 1 rad/s, amount of distortion: 20% or less) of a binder resin becomes 10,000 Pa is defined as Tm, Tm of the binder resin used in the present exemplary embodiment is preferably from 80° C. to 150° C. Here, the loss elastic modulus of the binder resin is measured as follows. As a measuring apparatus, a rheometer (trade name: RDA II, manufactured by Rheometrics Co., Ltd., RHIOS system ver. 4.3) is used. A parallel plate having a diameter of 8 mm is used as a measuring plate. The measurement conditions are such that a zero point adjustment temperature is 90° C., an interplate gap is 3.5 mm, the temperature rising rate is 1° C./minute, the initial measured distortion is 0.01%, and the measurement initiation temperature is 30° C. The distortion is adjusted while the temperature is increased such that the detected torque is maintained about 10 gcm. The maximum distortion is set to be 20%. When the detection torque becomes lower than the minimum value of a measurement certified range, measurement is completed.

The softening temperature of the noncrystalline polyester resin used in the present exemplary embodiment is preferably from 80° C. to 140° C., and more preferably from 95° C. to 135° C. When the softening temperature is less than 80° C., stability of the toner and/or toner image may be deteriorated after fixing or during storage. When the softening temperature exceeds 140° C., low-temperature fixability of the toner may be deteriorated. Here, the softening temperature of a resin represents a midpoint temperature between the melting initiation temperature and the melting completion temperature, which is measured using a flow tester (trade name: CFT-500C, manufactured by Shimadzu Corporation) under the following conditions:

Sample amount: 1.05 g,
Preheating: 300 seconds at 65° C.,
Plunger pressure: 0.980665 MPa,
Die size: diameter 1 mm, and
Temperature rising rate: 1.0° C./minute.

In the present exemplary embodiment, a crystalline polyester resin is used as a binder resin of the toner for the purpose of improving image glossiness, stability, and low-temperature fixability of the toner. The crystalline polyester resin preferably has an appropriate compatibility with a noncrystalline polyester resin. When an aliphatic crystalline polyester resin is used, the aliphatic crystalline polyester resin has compatibility with a noncrystalline polyester resin and thus produces effects of plasticizing the binder resin, whereby a low-temperature fixability and sufficient image glossiness may be obtained. Therefore, the use of an aliphatic crystalline polyester resin is preferable.

The crystalline polyester resin used in the present exemplary embodiment is synthesized using at least one divalent acid (dicarboxylic acid) component and at least one dihydric alcohol (diol) component. In the present exemplary embodiment, the "crystalline polyester resin" represents a resin showing a clear endothermic peak in the differential scanning calorimetry (DSC), with no stepwise endothermic change. Further, even when components other than the crystalline polyester are polymerized in the main chain of the crystalline polyester resin, the copolymer is also included in the scope of the crystalline polyester resins as long as the amount of other components is 50% by weight or less. In the following description, a component that was an acid component before the polyester resin is synthesized is referred to as a "component derived from an acid", and a component that was an alcohol component before the polyester resin is synthesized is referred to as a "component derived from an alcohol".

Component Derived from Acid

The acid for forming the component derived from an acid is preferably an aliphatic dicarboxylic acid, and more preferably a straight-chain carboxylic acid. Examples of the straight-chain carboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid; and lower alkyl esters and acid anhydrides thereof. Among these, a straight-chain dicarboxylic acid having 6 to 10 carbon atoms may be preferably used in consideration of the crystalline melting temperature of the crystalline polyester resin or charging properties of the toner. In order to increase crystallinity of the crystalline polyester resin, the straight-chain dicarboxylic acid is preferably used in an amount of 95% by mol or more, and more preferably 98% by mol or more, with respect to the total amount of the component derived from an acid.

It is preferable that the at least one component derived from an acid include a component derived from a dicarboxylic acid having a sulfonic group in addition to the above-described component derived from the aliphatic dicarboxylic acid.

The dicarboxylic acid having the sulfonic group may be effective in that it may improve dispersion state of a colorant such as a pigment. Further, as described below, the sulfonic group allows the resin to be emulsified or suspended without using a surfactant when the entire resin is emulsified or suspended to produce the toner particles.

Examples of the dicarboxylic acid having the sulfonic group include, but are not limited to, a sodium salt of 2-sulfoterephthalic acid, a sodium salt of 5-sulfoisophthalic acid, a sodium salt of sulfosuccinic acid; and lower alkyl esters and acid anhydrides thereof. Among these, the sodium salt of 5-sulfoisophthalic acid is preferable in view of the cost. The content of dicarboxylic acid having the sulfonic group is preferably from 0.1% by mole to 2.0% by mole, and more preferably from 0.2% by mole to 1.0% by mole. When the content exceeds 2.0% by mole, the charging properties of the toner may be deteriorated. In the present exemplary embodiment, constitutional "% by mole" represents a percentage when the total amount of each component in the polyester resin (a component derived from an acid or a component derived from an alcohol) is set as 1 unit (mol).

Component Derived from Alcohol

The component derived from an alcohol is preferably an aliphatic dialcohol. Examples of the aliphatic dialcohol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these, an aliphatic dialcohol having 6 to 10 carbon atoms is preferable in consideration of the crystalline melting temperature of the crystalline polyester resin or charging properties of the toner. In order to increase crystallinity of the crystalline polyester resin, the straight-chain dialcohol is preferably used in an amount of 95% by mol or more, and more preferably 98% by mol or more, with respect to the total amount of the component derived from an alcohol.

Other examples of the dialcohol include bisphenol A, hydrogenated bisphenol A, ethylene oxide and/or propylene oxide adducts of bisphenol A, 1,4-cyclohexanediol, 1,4-cyclohexane dimethanol, diethylene glycol, propylene glycol, dipropylene glycol, 1,3-butanediol, and neopentyl glycol. The dialcohol may be used singly, or in combination of two or more thereof.

If necessary, for the purpose of adjusting the acid value or hydroxyl value, a monovalent acid such as acetic acid or benzoic acid; a monohydric alcohol such as cyclohexanol or benzyl alcohol; a benzene tricarboxylic acid, naphthalene tricarboxylic acid, or anhydrides or lower alkyl esters thereof; or a trihydric alcohol such as glycerin, trimethylolpropane, or pentaerythritol may also be used.

Other monomers used for the crystalline polyester resin is not particularly limited. For example, a known monomer component such as a divalent carboxylic acid or a dihydric alcohol, as described in "Polymer Data Handbook: Basic Part" (edited by the society of Polymer Science, Japan; and published by Baifukan Co., Ltd.), may be used. Specific examples of the monomer component include a divalent carboxylic acid such as dibasic acids including phthalic acid, isophthalic acid, terephthalic acid, naphthalene-2,6-dicarboxylic acid, naphthalene-2,7-dicarboxylic acid, cyclohexane dicarboxylic acid; and anhydrides or lower alkyl esters thereof. The monomer may be used singly, or in combination of two or more thereof.

The crystalline polyester resin may be prepared from any combination of the above-described monomers by using known methods described, for example, in "Polycondensation" (published by Kagaku-dojin Publishing Company), "Experiments in Polymer Science—polycondensation and polyaddition" (published by Kyoritsu Shuppan Co., Ltd.), and "Polyester Resin Handbook" (edited by Nikkankogyo Shimbun Ed.). An ester exchange method or a direct polycondensation method may be used, and these methods may be used in combination.

When the component derived from an acid and the component derived from an alcohol are allowed to react each other, the molar ratio of the component derived from an acid to the component derived from an alcohol (component derived from an acid/component derived from an alcohol) varies depending on the reaction condition, and is not limited to a particular value. When direct polycondensation of these components is conducted, the molar ratio of the component derived from an acid to the component derived from an alcohol (component derived from an acid/component derived from an alcohol) may be 1/1. When an ester exchange method is used, an excess amount of a monomer removable by distillation under vacuum such as ethylene glycol, neopentyl glycol, or cyclohexanedimethanol may be used. The production of the crystalline polyester resin may be conducted at a polymerization temperature of from 180° C. to 250° C., and if necessary, the pressure within the reaction system is reduced and the reaction is conducted while removing water or alcohol generated during the condensation reaction. When the monomer does not dissolve in or is not compatible with the solvent under the reaction temperature, a solvent having a high boiling temperature may be added as a solubilizing co-solvent to dissolve the monomer.

The polycondensation reaction is conducted while distilling away the solubilizing co-solvent. When a monomer having low compatibility exists in the copolymerization reaction, the monomer having low compatibility may be previously condensed with an acid or alcohol to be polycondensed with the monomer, and then polycondensation reaction with main components may be conducted.

Examples of a catalyst that can be used in crystalline polyester resin preparation include a compound of an alkali metal such as sodium or lithium; a compound of an alkali earth metal such as magnesium or calcium; a compound of a metal such as zinc, manganese, antimony, titanium, tin, zirconium, or germanium; a phosphite compound; a phosphate compound, and an amine compound. Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenyl phosphonium bromide, triethyl amine, and triphenyl amine. Among these, in consideration of charging properties, a tin-containing catalyst and a titanium containing catalyst are preferable, and a dibutyltin oxide is preferably used.

The melting temperature of the crystalline polyester resin in the present exemplary embodiment is preferably from 50° C. to 120° C., and more preferably from 60° C. to 110° C. When the melting temperature is less than 50° C., the storability of the toner and/or the storability of a toner image after fixing may be unsatisfactory. When the melting temperature is more than 120° C., low-temperature fixability may be insufficient compared to that of conventional toners.

In the present exemplary embodiment, the measurement of the melting temperature of the crystalline polyester resin is performed using a differential scanning calorimeter (DSC), and the melting temperature can be obtained as a melting peak temperature in a power-compensation differential scanning calorimetry according to JIS K-7121 performed from room temperature to 150° C. at a temperature increase rate of 10° C./min. There may be a crystalline resin that shows plural melting peaks, in which case the temperature giving the maximum peak is considered as the melting temperature of the crystalline resin in the present exemplary embodiment.

The content of the crystalline polyester resin in the binder resin is preferably from 1% by weight to 20% by weight (or from about 1% by weight to about 20% by weight), and more preferably from 4% by weight to 14% by weight (or from about 4% by weight to about 14% by weight). When the amount of the crystalline polyester resin exceeds 20% by weight, the domain of the crystalline polyester resin may become larger and the domain may be exposed on the surface of the toner, thereby powder flowability of the toner may be degraded or charging properties may be deteriorated.

Examples of a colorant used in the toner of the present exemplary embodiment include a yellow pigment. Examples of the yellow pigment include chrome yellow, zinc yellow, yellow iron oxide, cadmium yellow, chromium yellow, Hansa yellow, Hansa yellow 10G, benzidine yellow G, benzidine yellow GR, threne yellow, quinoline yellow, and permanent yellow NCG. Among these, C.I. pigment yellow 17, C.I. pigment yellow 74, C.I. pigment yellow 97, C.I. pigment yellow 155, C.I. pigment yellow 180, and C.I. pigment yellow 185 are preferably used.

Examples of a magenta pigment include red iron oxide, cadmium red, red lead, mercury sulfide, watchung red, permanent red 4R, lithol red, brilliant carmine 3B, brilliant carmine 6B, DuPont Oil red, pyrazolone red, rhodamine B lake, lake red C, rose bengal, eoxine red, alizarin lake; naphthol pigments such as pigment red 31, pigment red 146, pigment red 147, pigment red 150, pigment red 176, pigment red 238, and pigment red 269; and quinacridone pigments such as pigment red 122, pigment red 202, and pigment red 209. Of these, in view of productivity and charging properties, pigment red 185, pigment red 238, pigment red 269, and pigment red 122 are preferable.

Examples of a cyan pigment include iron blue, cobalt blue, alkali blue lake, Victoria blue lake, fast sky blue, Indanthrene blue BC, aniline blue, ultramarine blue, Calco Oil blue, methylene blue chloride, phthalocyanine blue, phthalocyanine green, malachite green oxalate. Among these, C.I. pigment blue 15:1 and C.I. pigment blue 15:3 are preferably used.

Examples of a black pigment that is used for a black toner include carbon black, copper oxide, manganese dioxide, aniline black, and active carbon. Among these, carbon black is preferable. Since carbon black is relatively high dispersibility, carbon black does not need a special dispersant. However, carbon black is preferably manufactured by a manufacturing method similar to that for a color colorant.

The colorant used in the toner of the present exemplary embodiment may be selected in consideration of hue angle, chroma, brightness, weather resistance, OHP transparency, and dispersibility in the toner. The colorant may be added in an amount of from 4% by weight to 15% by weight with respect to the total weight of the solid component of the toner. When a magnetic material is used as the black colorant, the magnetic material may be added in an amount of from 12% by weight to 24% by weight, which is different from the amount of other colorants. Specifically, as the magnetic material, a material that can be magnetized in a magnetic field may be used, and examples thereof include a ferromagnetic powder such as a powder of iron, cobalt, or nickel; and a compound such as ferrite or magnetite. When the toner is prepared in an aqueous medium, it is necessary to pay attention to transfer of the magnetic material to aqueous phase, and the surface of the magnetic material is preferably modified in advance, for example, through a hydrophobic treatment.

A dispersant used in a dispersant of the colorant is generally a surfactant. Examples of the surfactant include anionic surfactants such as sulfate ester salts, sulfonate salts, phosphate esters, and soaps; cationic surfactants such as amine salts and quaternary ammonium salts; nonionic surfactants such as polyethylene glycols, alkyl phenol ethylene oxide adducts, and polyhydric alcohols. Among these, ionic surfactants are preferable, and anionic surfactants and cationic surfactants are more preferable. Nonionic surfactants are preferably used together with anionic surfactants or cationic surfactants. The surfactant may be used singly, or in combination two or more thereof. It is preferable that the surfactant has the same polarity as dispersants used in other dispersion liquids such as a dispersion liquid of a releasing agent.

Specific examples of the anionic surfactant include fatty acid soaps such as potassium laurate, sodium oleate, and castor oil sodium; sulfate esters such as octyl sulfate, lauryl sulfate, lauryl ether sulfate, and nonyl phenyl ether sulfate; sulfonates such as lauryl sulfonate, dodecyl sulfonate, dodecylbenzene sulfonate, sodium alkylnaphthalene sulfonate such as triisopropylnaphthalene sulfonate and dibutylnaphthalene sulfonate, naphthalenesulfonate formalin condensate, monooctylsulfosuccinate, dioctylsulfosuccinate, lauric acid amide sulfonate, and oleic acid amide sulfonate; phosphate esters such as lauryl phosphate, isopropyl phosphate, and nonyl phenyl ether phosphate; sodium dialkylsulfosuccinate such as sodium dioctylsulfosuccinate; and sulfosuccinate salts such as disodium lauryl sulfosuccinate, disodium lauryl polyoxyethylenesulfosuccinate.

Specific examples of the cationic surfactant include amine salts such as laurylamine hydrochloride salt, stearylamine hydrochloride salt, oleylamine acetate salt, stearylamine acetate salt, and stearylaminopropylamine acetate salt; and quaternary ammonium salts such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bis(polyoxyethylene)methyl ammonium chloride, lauroyl aminopropyl dimethyl ethyl ammonium ethosulfate, lauroyl aminopropyl dimethylhydroxyethyl ammonium perchlorate, alkylbenzene dimethyl ammonium chloride, and alkyl trimethyl ammonium chloride.

Specific examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkyl amines such as polyoxyethylene lauryl aminoether, polyoxyethylene stearyl aminoether, polyoxyethylene oleyl aminoether, polyoxyethylene soy aminoether, and polyoxyethylene tallow aminoether; alkyl amides such as polyoxyethylene lauramide, polyoxyethylene stearamide, and polyoxyethylene oleamide; vegetable oil ethers such as polyoxyethylene castor oil ether, and polyoxyethylene rape seed oil ether; alkanol amides such as diethanolamide laurate, diethanolamide stearate, and diethanolamide oleate; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The addition amount of the dispersant is preferably from 2% by weight to 30% by weight, and more preferably from 5% by weight to 20% by weight, with respect to the colorant. When the amount of the dispersant is too low, the particle diameter may not be made small, or storage stability of the dispersion liquid may be degraded. When the amount of the dispersant is too high, the amount of the dispersant that remains in the toner becomes large, and charging properties or powder flowability of the toner may be degraded.

As the aqueous dispersion medium, distilled water or ion-exchanged water, which has a small amount of impurities, such as metal ions, is preferably used. In addition, for the purpose of defoaming or adjustment of surface tension, alcohol may also be added. Furthermore, for the purpose of adjusting the viscosity, polyvinyl alcohol or cellulose-based polymer may also be added.

The toner of the present exemplary embodiment may contain a releasing agent to improve fixability or image storage stability. As the releasing agent, a material having a temperature showing a main maximum endothermic peak of from 60° C. to 120° C. in the DSC measured based on ASTM D3418-8, and melting viscosity of from 1 to 50 mPa·s at 140° C. may preferably be used. When the melting temperature is less than 60° C., the change temperature of the releasing agent (for example, wax) may be too low, and thus blocking resistance may be degraded, or developability may be deteriorated when the temperature in the copy machine is increased. When the melting temperature exceeds 120° C., the change temperature of the releasing agent (for example, wax) may be too high. In this case, fixing may be conducted at high temperatures, but it may be undesirable in view of energy saving. In addition, at the melting viscosity higher than 50 mPa·s at 140° C., exudation from the toner may be weak, and releasability at fixation may be insufficient.

The melting viscosity of the releasing agent used in the present exemplary embodiment is measured by an E-type viscometer. For measurement, an E-type viscometer (manufactured by Tokyo Keiki Co., Ltd.) equipped with an oil circulating constant temperature bath is used.

Measurements are conducted using a cone plate-cup combination plate with a cone angle of 1.34 degrees. A sample is placed in the cup, with the temperature of the circulation device set to 140° C., an empty measuring cup and cone are set in the measuring device, and a constant temperature is maintained while circulating the oil. Once the temperature has stabilized, 1 g of a sample is placed in the measuring cup and then left to stand for 10 minutes with the cone in a stationary state. After stabilization, the cone is rotated and the measurement is conducted. The cone rotational speed is set to 60 rpm. The measurement is conducted three times, and the average of the resultant values is recorded as the melting viscosity $\eta$.

The endothermic initiation temperature of the releasing agent, in the DSC curve, is preferably 40° C. or more, and more preferably 50° C. or more, which is measured by the differential scanning calorimeter. When the endothermic initiation temperature is lower than 40° C., the toner may be aggregated within the copy machine or the toner bottle.

The endothermic initiation temperature varies depending on the kind and quantity of a low molecular weight fraction within molecular weight distribution of the releasing agent (for example, wax), as well as the kind and quantity of polar groups within the low molecular weight fraction. Generally, when the molecular weight is increased, the endothermic initiation temperature increases together with the melting temperature, however the increase in the endothermic initiation temperature results in a loss of the inherent low melting temperature and low viscosity of the releasing agent (for example, wax). Accordingly, it is effective to selectively remove the low molecular weight fraction from the molecular weight distribution of the releasing agent (for example, wax). Examples of a method therefor include molecular distillation, solvent fractionation, and gas chromatographic separation.

In the releasing agent, when the temperature showing the maximum endothermic peak is less than 50° C., offset may easily occur at the time of fixing. When the temperature showing the maximum endothermic peak is more than 140° C., the fixing temperature is high and a smooth surface of a fixed image may not be obtained, such that the glossiness of the surface of the fixed image may be impaired.

The measurement according to DSC may be performed using, for example, a DSC-7 (trade name) manufactured by Perkin Elmer Inc. The temperature detected by the detection unit of the apparatus is corrected based on the melting temperatures of indium and zinc, and the heat amount is corrected based on the heat of melting of indium. The sample is loaded on an aluminum pan, and a blank pan is set as a control. The measurement is performed at a temperature increase rate of 10° C./min.

Specific examples of the releasing agent include low-molecular-weight polyolefins such as polyethylene, polypropylene, and polybutene; silicones that show a softening temperature under heating; fatty acid amides such as oleyl amide, erucyl amide, ricinoleyl amide, and stearyl amide; vegetable waxes such as carnauba wax, rice wax, candelilla wax, Japan wax, and jojoba oil; animal waxes such as bees wax; mineral or petroleum waxes such as montan wax, ozokerite, ceresin, paraffin wax, microcrystalline wax, and Fischer-Tropsch wax; and modified products thereof.

A dispersion liquid of the releasing agent may be prepared by dispersing the releasing agent in water together with a polymer electrolyte such as an ionic surfactant, a polymeric acid, or a polymeric base, and dispersing the releasing agent to form particles using a homogenizer or pressure-discharge-type dispersing machine (for example, a Gaulin homogenizer manufactured by APV Gaulin Inc.) capable of applying a strong shearing force while heating the mixture liquid to a temperature that is equal to or higher than the melting temperature of the releasing agent. The particle diameter of the releasing agent particles in the releasing agent particle dispersion liquid may be measured, for example, with a Doppler-scattering-type particle size distribution measuring instrument or a laser-diffraction-type particle size distribution measuring instrument (for example, an LA-700 (trade name) manufactured by Horiba Ltd.)

The ratio of the amount of the dispersant to the amount of the releasing agent in the releasing agent dispersing liquid is preferably from 1% by weight to 20% by weight, and more preferably from 2% by weight to 10% by weight. When the ratio of the dispersant is too low, the releasing agent may not be dispersed sufficiently, and the storage stability of the releasing agent may be inferior. When the ratio of the releasing agent is too high, the charging properties of the toner, particularly stability of the toner against varied environment, may be deteriorated. The dispersant may be selected from those mentioned above as examples of dispersants usable for dispersing the colorant, so as to choose the most suitable dispersant for the kind of wax to be used.

The method for producing a toner of the present exemplary embodiment is preferably a wet production method in view of reducing the effect of the fixing speed on the fixing properties, preventing toner blocking, and obtaining excellent storability at high temperatures. The production method is more preferably an emulsion aggregation method.

In what follows, the method of producing an electrophotographic toner of the present exemplary embodiment is described, taking an emulsion aggregation method as an example. An emulsion aggregation method is a production method including a step of forming aggregated particles in a dispersion liquid in which at least resin particles are dispersed so as to prepare an aggregated particle dispersion liquid (aggregation step), and a step of heating the aggregated particle dispersion liquid so as to fuse the aggregated particles (fusing step). Hereinafter, the production method described above is sometimes referred to as "aggregation-fusion method".

In addition, a step (attachment step) may also be provided between the aggregation step and the fusing step. In the attachment step, a particle dispersion liquid in which particles (additional particles) are dispersed is added to the aggregated particle dispersion liquid and mixed so as to attach the additional particles to the aggregated particles and form aggregated particles having the additional particles attached thereto.

The attachment step is a step of attaching the additional particles to the aggregated particles by adding the particle dispersion liquid to the aggregated particle dispersion liquid prepared in the aggregation step and mixing the resultant mixture. Since the particles added in the attachment step are particles that are newly added to the aggregated particles, the particles may sometimes be referred to as "additional particles" in the specification.

Examples of the additional particles include particles of the above-mentioned resin, particles of a releasing agent and particles of a colorant. The additional particles may include particles of one type only, or may include a combination of plural types of particles. The method of adding and mixing the particle dispersion liquid is not particularly limited, and the particle dispersion liquid may be either added gradually in a continuous manner, or added in a stepwise manner through repeated additional operations. By adding and mixing the particles (additional particles) in this manner, the generation of excessively small particles may be suppressed and the particle diameter distribution of the obtained electrophotographic toner particles may be narrowed, which contributes to improvement of image quality.

Effect of the adhesion step include the following: A pseudo-shell structure may be formed and the exposure of internal additives such as a colorant and a releasing agent on the surface of the toner may be reduced, as a result of which charging properties and lifespan may be improved; In addition, during fusing in the fusing step, the particle diameter distribution may be maintained and fluctuations in the distribution may be suppressed; the necessity for the addition of surfactants or stabilizers, such as bases or acids, to enhance the stability during fusing may be removed, or the addition quantities of such materials may be minimized; and resultantly, costs may be reduced and quality may be improved.

Accordingly, when a releasing agent is used, it is preferable to add additional particles mainly including resin particles. When using this method, the shape of the toner particles may be controlled easily during the fusing step by adjusting conditions such as the temperature, stirring speed, and pH.

After the fusing and/or attachment step is completed, the obtained particles are washed and dried to obtain the toner particles. In consideration of charging properties of the toner, it is preferable to sufficiently conduct displacement washing of the toner with ion-exchanged water, and the degree of cleaning is generally monitored by conductivity of a filtrate. The final conductivity of the filtrate is preferably 30 mS or less. The washing step may include a step of neutralizing ions with an acid or an alkali. Treatment with an acid is preferably conducted such that the pH of the ion-exchanged water during the displacement washing becomes 4.0 or less. Treatment with an alkali is preferably conducted such that the pH of the ion-exchanged water during the displacement washing becomes 8.0 or more.

The solid-liquid separation performed after washing is not particularly limited, and is preferably performed by suction-filtration or pressure-filtration in view of improving productivity. The drying method is not particularly limited, but freeze-drying, flash-jet drying, fluidized drying, or vibrating fluidized drying is preferable from the viewpoint of productivity.

In the present exemplary embodiment, the toner includes appropriate amounts of a ketone solvent and an alcoholic solvent, while the toner particle surface should be dried intensively. In order enable this, it is preferable to use a flash dryer. When a flash dryer is used, wet toner particles are dispersed in and transported by a high-speed air stream, so that the contact area between each wet toner particle and the air stream is large, as a result of which the drying efficiency is excellent and water and trace amounts of organic solvents present at the toner particle surface can be evaporated instantaneously.

The temperature during drying is preferably from 35° C. to 55° C., and more preferably from 40° C. to 50° C., in view of drying the toner particle surface intensively. When the drying temperature is less than 35° C., drying is insufficient and a large amount of solvent and water may remain at the toner surface. When the drying temperature is more than 55° C., toner blocking may occur due to the heat supplied for drying.

When a polyester resin is used in the emulsion aggregation method, the method may include an emulsification step of emulsifying the polyester resin so as to form emulsion particles (liquid droplets), an aggregation step of forming aggregates of the emulsion particles (liquid droplets), and a coalescence step of thermally coalescing the particles in each aggregate at a temperature that is not less than the glass transition temperature of the polyester resin (when the polyester resin is noncrystalline) or not less than the melting temperature of the polyester resin (when the polyester resin is crystalline).

Examples of the method for including a solvent in the toner include a method in which a resin containing a solvent is used for producing a toner, a method in which a solvent is added during the production process of a toner, and a method in which a solvent is adsorbed to a toner by exposing the toner to an atmosphere of the solvent after the production of the toner. The method in which a resin containing a solvent is used for producing a toner is preferable in consideration of productivity and effects. In particular, it is preferable to dissolve a polyester resin in a solvent and prepare a resin emulsion liquid by a phase inversion emulsification method utilizing the self-neutralizing property of the polyester resin.

Preparation of Resin Emulsion Liquid by Phase Inversion Emulsification Method

Specifically, the production of a resin emulsion liquid by a phase inversion method preferably includes dissolving a polyester resin in an organic solvent that has a boiling temperature of 100° C. or less or that is capable of forming an azeotropic mixture with water adding a basic compound thereto to form an oil phase, gradually adding an aqueous medium dropwise to the obtained oil phase while stirring so as to form a resin emulsion through phase inversion, and removing excessive organic solvent, whereby a resin particle dispersion liquid (emulsion liquid) is obtained. When the acid value of the resin is from 5 mgKOH/g to 25 mgKOH/g, both of a resin particle dispersion liquid of the crystalline polyester resin and a resin particle dispersion liquid of the noncrystalline polyester resin can be prepared by the phase inversion emulsification method. In particular, it is preferable to use the phase inversion emulsification method when preparing a noncrystalline resin particle dispersion liquid.

The solvent used at the time of producing a resin emulsion liquid through the phase inversion emulsification method may be an amphoteric organic solvent that can plasticize the resin. The organic solvent is preferably a common organic solvent that has a boiling temperature of 100° C. or less or is capable of forming an azeotropic mixture with water and that is low in toxicity, explosiveness, and flammability. When an organic solvent having a boiling temperature of 100° C. or less or being capable of forming an azeotropic mixture with water is used, the organic solvent may be sufficiently removed in a subsequent step, which is preferable.

Organic Solvent

In the present exemplary embodiment, the ketone solvent and alcoholic solvent described above are used as amphoteric organic solvents. Other examples of the amphoteric organic solvent include esters such as ethyl acetate, n-propyl acetate, isopropyl acetate, tert-butyl acetate, methyl propionate, ethyl propionate, and dimethyl carbonate, glycol derivatives such as ethyleneglycol dimethyl ether and propyleneglycol dimethyl ether, and acetonitrile. The amphoteric organic solvent may be used singly, or in combination of two or more thereof.

Basic Compound

When the resin in the present exemplary embodiment is dispersed in an aqueous medium by the phase inversion emulsification method, the resin is preferably neutralized with a basic compound. When a polyester resin is used as at least one of the noncrystalline resin and/or the crystalline resin in the present exemplary embodiment, the neutralization reaction of the carboxyl groups of the polyester resin serves as a driving force of hydrophilization and, further, cohesion of the particles may be prevented by an electric repulsive force between the generated carboxylic anions. The basic compound is preferably a volatile compound, which may be, for example, ammonia or an organic amine compound having a boiling temperature of 250° C. or less. Preferable examples of the organic amine compound include triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine, and N-ethylmorpholine.

The amount of the basic compound to be added may be selected in accordance with the amount of the carboxyl groups contained in the polyester resin, and is preferably such an amount that the carboxyl groups contained in the polyester resin are neutralized, at least partially, with the basic compound. For example, the amount of the basic compound is preferably from 0.2 to 4 equivalents of the amount of the carboxyl groups, and more preferably from 0.4 to 1.5 equivalents of the amount of the carboxyl groups. When the addition amount of the basic compound is 0.2 equivalents or more, the expected effects of the addition of the basic compound may be obtained. When the addition amount of the basic compound is 4 equivalents or less, the viscosity of the water dispersion of the polyester resin may not increase greatly. Therefore, the above range is preferable.

Adjustment of Organic Solvent Amount in Resin Particle Dispersion Liquid

The amounts of volatile substances such as organic solvents may be adjusted by any method such as a method of heating the resin particle dispersion liquid at reduced pressure, a bubbling method of blowing nitrogen and/or water vapor into the resin particle dispersion liquid, a stripping method, or a flashing method. From the viewpoint of obtaining excellent efficiency in volatile substance removal, the method of heating at reduced pressure is preferable.

According to the method described above, the amounts of volatile substances, such as organic solvents, in the resin emulsion can be adjusted.

The pressure inside the evaporation tank may be determined based on the processing temperature and the vapor pressure of the dispersion medium (usually water). In the present exemplary embodiment, it is preferable to appropriately regulate the pressure. The pressure is preferably from $5.33\times10^3$ to $6.67\times10^4$ Pa (from 40 to 500 torr), and more preferably from $6.67\times10^3$ to $5.33\times10^4$ Pa (from 50 to 400 torr). When the pressure inside the evaporation tank is within the above range, toner cohesion, scale adhesion to the tank wall, and foaming may be prevented efficiently, which is preferable.

In order to facilitate the evaporation of volatile substances in the dispersion liquid, a reduced-pressure stripping may be performed while blowing a gas into the liquid phase in the evaporation tank, as long as the balance of the system temperature or pressure is not destabilized. The gas to be blown into the liquid phase is not particularly limited, and examples thereof include water vapor, dry air, nitrogen, argon, helium, and carbon dioxide. Among these, inflammable gases are preferable. When the gas is blown into the liquid phase, the gas temperature is preferably less than 100° C. in view of preventing aggregation of polymer particles.

In the present exemplary embodiment, a surfactant may be added to the resin emulsion liquid. Examples of the surfactant include, but not limited to, anionic surfactants such as sulfate ester salts, sulfonate salts, phosphate esters, and soaps; cationic surfactants such as amine salts and quaternary ammonium salts; nonionic surfactants such as polyethylene glycols, alkyl phenol ethylene oxide adducts, and polyhydric alcohols. Among these, anionic surfactants and cationic surfactants are preferable. Nonionic surfactants are preferably used together in combination with anionic surfactants or cationic surfactants. The surfactant may be used singly, or in combination of two or more thereof.

Specific examples of the anionic surfactant include sodium dodecylbenzene sulfonate, sodium dodecyl sulfate, sodium alkylnaphthalene sulfonate, and sodium dialkylsulfosuccinate. Specific examples of the cationic surfactant include alkylbenzene dimethyl ammonium chloride, alkyl trimethyl ammonium chloride, and distearyl ammonium chloride.

In the aggregation step, the obtained emulsion particles are aggregated by being heated to a temperature that is near, but no higher than, the melting temperature of the polyester resin, whereby aggregates are formed. The formation of aggregates of emulsion particles may be allowed to proceed by shifting the pH of the emulsion liquid to the acidic side while stirring. The target pH is preferably from 2 to 5, and is more preferably from 2.5 to 4.

In the aggregation step, a coagulant is preferably used to form the aggregates. As the coagulant, surfactants having a polarity opposite to that of the surfactant used for the dispersant, or general inorganic metal compounds (e.g., inorganic metal salt) or polymers thereof may be used. The metal element of the inorganic metal salt is preferably a metal element having a di- or higher-valent, belonging to any of Groups 2A, 3A, 4A, 5A, 6A, 7A, 8, 1B, 2B, and 3B of the periodic table (long form of the periodic table), and being capable of dissolving in the form of an ion in the aggregation system of the resin particles.

Preferable examples of the inorganic metal salt include metal salts such as calcium chloride, calcium nitrate, barium chloride, magnesium chloride, zinc chloride, aluminum chloride, aluminum sulfate, and inorganic metal salt polymers such as poly(aluminum chloride), poly(aluminum hydroxide), and poly(calcium sulfide). Among these, aluminum salts and polymers thereof are preferable.

In general, in terms of obtaining a narrower particle size distribution, the valency of the inorganic metal salt is preferably higher (for example, divalent is preferred to monovalent, and tri- or higher-valency is preferred to divalent), and an inorganic metal salt polymer, which is a polymer coagulant, is preferable even with the same valency number. Addition of a coagulant to the toner of the present exemplary embodiment is preferable, considering that the coagulant may improve the stability of the toner particles and realize a narrower toner particle size distribution and that the viscoelasticity of the toner may be controlled by changing the cohesion force between the ingredients by controlling the valency number and addition amount of the coagulant.

When the toner of the present exemplary embodiment contains at least one metal element selected from aluminum, zinc, or calcium, the at least one metal element is preferably added in the form of a coagulant. The addition amount of the coagulant varies depending on the kind and valency of the coagulant, but is in a range of from about 0.05% by weight to about 0.1% by weight.

In the toner preparation process, not the entire portion of the added coagulant remains in the toner, since the coagulant disperses into an aqueous medium and/or forms coarse particles. Particularly, in the toner preparation process, when the amount of the solvent in the resin is large, the solvent and the coagulant react with each other, and thus the coagulant easily disperses into the aqueous medium. Accordingly, it is necessary to adjust the amount of the coagulant according to the residual amount of the solvent.

In the coalescence step, pH of a suspension liquid of the aggregates is set in a range of from 5 to 10 to interrupt the progress of aggregation, while stirring the suspension liquid under a condition similar to that in the aggregation step. Then, heating is conducted at a temperature that is not less than the melting temperature of the crystalline polyester resin, whereby each aggregate is fused and coalesced. The heating temperature is not limited as long as the temperature is not less than the melting temperature of the crystalline polyester resin. The heating may be conducted for a time enough to complete the coalescing reaction, for example, for about 0.2 to about 10 hours. The shape and surface properties of the particles varies depending on the decreasing rate of the temperature during solidification of particles when decreasing the temperature for solidifying the particles down to a temperature not more than the crystallization temperature of the crystalline polyester resin. For example, when the temperature is decreased rapidly, the particles tend to have spherical form and surface of the particles tends to be smoothened. When the temperature is decreased slowly, the particles tend to have an amorphous form and the surface of the particles tends to be uneven. For this reason, the temperature is preferably decreased to the temperature not more than the crystallization temperature of the crystalline polyester resin at least at a rate of 0.5° C./minute or more, and more preferably at a rate of 1.0° C./minute or more.

In the toner of the present exemplary embodiment, inorganic particles or organic particles may be added. The reinforcing effect of these particles may improve the storage elastic modulus of the toner, and may improve the offset resistance or releasability from the fixing device. These particles may also improve dispersibility of the internal additives such as the colorant and the releasing agent.

Examples of the inorganic particles include silica, hydrophobized silica, alumina, titanium oxide, calcium carbonate, magnesium carbonate, tricalcium phosphate, colloidal silica, alumina-treated colloidal silica, cation surface-treated colloidal silica, and anion surface-treated colloidal silica. These inorganic particles may be used singly, or in combination two or more thereof. Among these, in view of OHP transparency and dispersibility within the toner, colloidal silica is preferable.

The particle diameter of the inorganic particles is preferably in a range of from 5 to 50 nm. The inorganic particles having different sizes may be used in combination. Although the particles can be added directly during the production of the toner, in order to improve dispersibility, it is preferable to use a dispersion liquid that has been produced in advance using an ultrasound disperser or the like to disperse the particles in an aqueous medium such as water In this dispersing process, an ionic surfactant, a polymeric acid, or s polymeric base may also be used to further improve dispersibility In the toner of the present exemplary embodiment, other known materials such as a charge controlling agent may be added. The average particle diameter of the materials added is preferably 1 μm or less, and more preferably in a range of from 0.01 to 1 μm. When the average particle diameter exceeds 1 μm, the particle diameter distribution of the final product of the toner for developing an electrostatic latent image may become wide or free particles may be generated, thereby performance and reliability of the toner may be deteriorated. When the average particle diameter is within the above range, the above-described problems may be avoided, uneven distribution among toner particles may be reduced, or dispersibility within the toner may be improved, thereby variation in performance and reliability of the toner may be reduced. The average particle diameter may be measured, for example, using a Microtruck or the like.

A device used for the production of a dispersion liquid of the above various additives in not particularly limited. Examples of the device include known dispersion devices such as a rotary shearing type homogenizer, media mills such as a ball mill, a sand mill, a Dino mill, and other devices used for the production of a colorant dispersion liquid or a releasing agent dispersion liquid. An appropriate device may be selectively used as required.

In the present exemplary embodiment, the charge to mass ratio of the toner in an absolute value is preferably in a range of from 10 to 70 μC/g, and more preferably in a range of from 15 to 50 μC/g. When the charge to mass ratio in an absolute value is less than 10 μC/g, stains may easily occur on the background. When the charge to mass ratio in an absolute value exceeds 70 μC/g, image density may tend to be degraded.

In addition, a ratio (HH/LL) between the charge amount under a high temperature and high humidity environment (HH) of 30° C. and 80 RH % and the charge amount under a low temperature and low humidity environment (LL) of 10° C. and 20 RH % is preferably in a range of from 0.5 to 1.5, and more preferably in a range of from 0.7 to 1.2. When the ratio is within the above ranges, a vivid image may be obtained without being affected by the environment.

The charge to mass ratio is largely affected by external additives. However, the charge to mass ratio of the bare toner particle to which external additives have not been added is naturally important. It is also preferable to reduce the total amount of surfactants used in a colorant dispersion liquid, a releasing agent dispersion liquid, and the like, and to sufficiently wash off any residual surfactants and ions.

The toner of the present exemplary embodiment preferably has a ratio (Mw/Mn) of weight average molecular weight (Mw) to number average molecular weight (Mn) within a range of from 2 to 30, and more preferably within a range of from 3 to 20, the weight average molecular weight and the number average molecular weight being measured using gel permeation chromatography. The ratio represents the dispersity of the molecular weight distribution. When the ratio (Mw/Mn) exceeds 30, the optical transparency and coloring properties may not be sufficient; in particular, when the electrophotographic toner having a (Mw/Mn) ratio exceeding 30 is developed or fixed on a film, the image displayed by transmitted light may be dark and unclear, or the toner may not allow light transmission and thus the displayed image may not be sufficiently colored. When the ratio (Mw/Mn) is less than 2, a decrease in toner viscosity at the time of fixing at high temperatures may be significant, thereby increasing a tendency for an offset phenomenon to occur. In contrast, when the ratio (Mw/Mn) is within the above range, the optical transparency and coloring properties may be sufficient, and decrease in the viscosity of the electrophotographic toner at the time of fixing at high temperatures may be prevented, thereby effectively suppressing occurrence of an offset phenomenon.

In the toner of the present exemplary embodiment, inorganic particles or organic particles may be added as external additives such as flowability aids, cleaning aids, and abrasives and the like.

Examples of the inorganic particles include particles which are usually used as the external additives to the surface of the toner such as silica, alumina, titanium oxide, calcium carbonate, magnesium carbonate, tricalcium phosphate, or cerium oxide. The inorganic particles of which surface is hydrophobized is preferable. The inorganic particles may be used to control toner characteristics such as charging properties, powder properties and storage stability, and suitability for system such as developability and transferability.

Examples of the organic particles include particles which are usually used as the external additives to the surface of the toner such as vinyl-based resins including styrene-based polymers, (meth)acryl-based polymers, ethylene-based polymers; polyester resin; silicone resin; and fluorine-based resin.

These particles are added to improve transferability, and the primary particle diameter thereof is preferably in a range of from 0.05 to 1.00 μm.

In the toner of the present exemplary embodiment, a lubricant may also be added. Examples of the lubricant include fatty acid amides such as ethylene bisstearamide and oleamide; fatty acid metal salts such as zinc stearate and calcium stearate; and higher alcohols such as UNILIN. The lubricant is generally added to improve a cleaning effect, and the primary particle diameter thereof may be in a range of from 0.1 to 5.0 μm.

In the toner of the present exemplary embodiment two or more types of the inorganic particles may be used as external additives, and at least one type of two or more types of the inorganic particles preferably has an volume average primary particle diameter from 30 nm to 200 nm, and more preferably from 30 nm to 180 nm.

When the toner has a smaller particle diameter, a non-electrostatic force of adhesion of the toner to the photoreceptor may be increased, which may result in defective transfer or image missing called hollow character and may cause uneven transfer when toner images are overlapped. Therefore, in order to improve transferability of the toner, it is preferable to add external additives having a large volume average primary particle diameter of from 30 nm to 200 nm to the toner.

When the volume average primary particle diameter is smaller than 30 nm, while initial toner flowability may be good, a non-electrostatic adhesive force between the toner and a photoreceptor may not be sufficiently reduced. For this reason, transfer efficiency may be degraded, thereby image missing may occur and uniformity of an image may be deteriorated. In addition, particles may be embedded in the surface of the toner due to a stress over time within a developing unit, electrostatic properties may be changed, and a problem such as a reduction in copy image density and fogging of a background portion may be caused.

When the volume average primary particle diameter excess 200 nm, the particles may easily detach from the surface of the toner particle, and flowability may be deteriorated.

Specifically, as the inorganic particles, silica, alumina, and titanium oxide are preferably used. It is preferable to use hydrophobized silica an essential component. It is more preferable to use silica and titanium oxide in combination. In order to improve the transferability, it is preferable to use organic particles having a particle diameter ranging from 80 nm to 500 nm in combination with inorganic particles. In the specification "particle diameter" represents "volume average particle diameter" unless otherwise specified.

The hydrophobizing agent used for hydrophobizing an external additive may be a known material, examples of which include a coupling agent such as a silane coupling agent, a titanate coupling agent, an aluminate coupling agent, or a zirconium coupling agent, a silicone oil, and a polymer used for a polymer coating treatment. The hydrophobizing agent may be used singly, or in combination of two or more thereof. Among these, it is preferable to use a silane coupling agent and/or a silicone oil. The silane coupling agent may be of any type, such as a chlorosilane coupling agent, an alkoxysilane coupling agent, a silazane coupling agent, or a special silylating agent.

Examples of the silane coupling agent include, but are not limited to, methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, ethyltrimethoxysilane, propyltrimethoxysilane, phemyltrimethoxysilane, diphenyldimethoxysilane, tetraethoxysilane, methyltriethoxysilane, dimethyldiethoxysilane, ethyltriethoxysilane, propyltriethoxysilane, phenyltriethoxysilane, diphenyldiethoxysilane, butyltrimethoxysilane, butyltriethoxysilane, isobutyltrimethoxysilane, hexyltrimethoxysilane, octyltrimethoxysilane, decyltrimethoxysilane, hexadecyltrimethoxysilane, trimethyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, vinyltriacetoxysilane, γ-methacryloxypropyltrimethoxysilane, β-(3,4-epoxycyclohexyl)ethyltrimethoxysilane, γ-glycidoxypropyltrimethoxysilane, γ-glycidoxypropyltriethoxysilane, γ-glycidoxypropylmethyldiethoxysilane, γ-mercaptopropyltrimethoxysilane, γ-chloropropyltrimethoxysilane; a fluorinated silane compound, which is obtained by substituting some of the hydrogen atoms in the silane compounds with fluorine atoms, such as trifluoropropyltrimethoxysilane, tridecafluorooctyltrimethoxysilane, heptadecafluorodecyltrimethoxysilane, heptadecafluorodecylmethyldimethoxysilane, tridecafluoro-1,1,2,2-tetrahydrooctyltriethoxysilane, 3,3,3-trifluoropropyltrimethoxysilane, heptadecafluoro-1,1,2,2-tetrahydrodecyltriethoxysilane, or 3-heptafluoroisopropoxypropyltriethoxysilane, and an aminosilane compound, which is obtained by substituting some of the hydrogen atoms of the silane compounds, such as those described above, with amino groups.

Examples of the silicone oil include, but are not limited to, dimethyl silicone oil, methyl hydrogen silicone oil, methyl phenyl silicone oil, cyclic dimethyl silicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil, amino-modified silicone oil, and fluorine-modified silicone oil. When hydrophobized external additive particles are used, the charge to mass ratio of the toner in high-humidity conditions may be improved, thereby improving stability of charging against varied environments. In the toner of the present exemplary embodiment, it is preferable that at least one of the external additives added to the toner is treated with a silicone oil or silicone oils.

The method for hydrophobizing the particles may be a known method. Examples thereof include the following.

i) A method in which a hydrophobizing agent is diluted by being mixed with a solvent such as tetrahydrofuran, toluene, ethyl acetate methyl ethyl ketone, or acetone; the obtained liquid is dripped or sprayed onto the particles that are forcibly stirred using a blender or the like, so that the liquid is sufficiently mixed with the particles; the obtained mixture is optionally washed and filtrated, and then is dried by heating; and the dried aggregates are pulverized using, for example, a blender or mortar.

ii) A method in which the particles are immersed in a solution of a hydrophobizing agent in a solvent, and are dried.

iii) A method in which the particles are dispersed in water to form a slurry, a hydrophobizing agent is dripped onto the slurry, and the particles are precipitated and dried by heating, followed by pulverization.

iv) A method in which the hydrophobizing agent is directly sprayed onto the particles.

The amount of the hydrophobizing agent to be attached to the particles is preferably from 0.01% by weight to 50% by weight, and more preferably from 0.1% by weight to 25% by weight, with respect to the weight of the particles. The attachment amount of the hydrophobizing agent can be changed by, for example, increasing the amount of the hydrophobizing agent to be added at the hydrophobizing step and/or changing the number of washing steps performed after the hydrophobizing treatment. The attachment amount of the hydrophobizing agent can be quantified with XPS or an elemental analysis. When the attachment amount of the hydrophobizing agent is too small, the charging properties may be decreased under high-humidity environments. When the attachment amount of the hydrophobizing agent is too large, the charge to mass ratio may become excessively high under low-humidity conditions, and/or the hydrophobizing agent that has fell off the particles may deteriorate the powder flowability of the developer.

The external additive may be attached or fixed to the toner particle surface by applying a mechanical impact force to a mixture of the external additive and toner particles by using a sample mill or a Henschel mixer.

Developer for Developing Electrostatic Charge Image

The developer of the present exemplary embodiment for developing an electrostatic charge image (hereinafter sometimes referred to as "developer of the present exemplary embodiment") includes the toner of the present exemplary embodiment described above.

The developer of the present exemplary embodiment may be, for example, a one-component developer composed of a toner only, or a two-component developer composed of a toner and a carrier. The two-component developer is preferable in view of its excellent charge maintaining properties and stability. The carrier is preferably a carrier covered with a resin, and is more preferably a carrier covered with a nitrogen-containing resin.

Examples of the nitrogen-containing resin include acrylic resins such as dimethylaminoethyl methacrylate, dimethyl acrylamide, and acrylonitrile; amino resins such as urea, urethane, melamine, guanamine and aniline; amide resins; urethane resins; and copolymer resins thereof.

As the coating resin of the carrier, two or more of the above nitrogen-containing resins may be used in combination. The nitrogen-containing resin and a resin not containing nitrogen may be used in combination. The nitrogen-containing resin may be down to particles and dispersed in a resin not containing nitrogen. It is preferable to use urea resin, urethane resin, melamine resin, or amide resin, since these resins have relative high negative chargeability and high hardness, and may suppress decrement of charge to mass ratio of the toner caused by detachment of the coating resin.

In general, the carrier has generally appropriate electrical resistance, for example, electrical resistivity of from about $10^9$ to about $10^{14}$ Ωcm. In a carrier having low electrical resistance such as $10^6$ Ωcm, for example, an iron power carrier, various problems may arise, including adhesion of the carrier to an image portion of a photoreceptor due to charge injection from the sleeve, or loss of a charge of a latent image through the carrier, which may cause disorder in the latent image or defects in an image. When the carrier is thickly coated with an insulating ("insulating" meaning volume resistivity of $10^{14}$ Ωcm or more; hereinafter, defined in the same way) resin, electrical resistance becomes too high and leakage of the carrier charge is inhibited. As a result, when the image has a large area, an edge effect, in which a central portion of the image has extremely low image density while the edge of the image is clear, may occur. Therefore, in order to adjust resistance of the carrier, it is preferable that a conductive ("conductive" meaning volume resistivity of $10^{10}$ Ωcm or less; hereinafter, defined in the same way) powder is dispersed in a layer of the coating resin.

Specific examples of the conductive powder include metals such as gold, silver, and copper; carbon black; semi-conductive ("semi-conductive" meaning volume resistivity of from $10^5$ to $10^{10}$ Ωcm; hereinafter, defined in the same way) oxides such as titanium oxide and zinc oxide; composite systems in which the surfaces of particles such as particles of titanium oxide, zinc oxide, barium sulfate, aluminum borate, or potassium titanate are coated with tin oxide, carbon black or metal. In view of production stability, cost, and sufficient conductivity, carbon black is preferable.

Examples of the method of forming the resin coating layer on the surface of the carrier core material include: an immersion method in which powder of the carrier core material is immersed within a coating layer-forming solution; a spray method in which a coating layer-forming solution is sprayed onto the surface of the carrier core material; a fluidized bed method in which a coating layer-forming solution is sprayed while the carrier core material is maintained in a floating state using an air flow; a kneader coat method in which the carrier core material and a coating layer-forming solution are mixed together in a kneader coater and the solvent is subsequently removed; and a powder coating method in which the coating resin is down to particles, and is then mixed with the carrier core material in a kneader coater at a temperature that is not less than the melting temperature of the coating resin, and subsequently cooled. Among these, the kneader coat method and the powder coating method are preferable.

The average thickness of the resin coating layer formed by the above method is preferably in a range of from 0.1 to 10 μm, and more preferably in a range of from 0.2 to 5 μm.

The core material (the carrier core material) used in the carrier is not particularly limited. Examples of the core material include magnetic metals such as iron, steel, nickel, and cobalt; magnetic oxides such as ferrite and magnetite; and glass beads. A magnetic carrier is preferably used for a magnetic brush method. The average particle diameter of the carrier core material is preferably in a range of from 10 to 100 μm, and more preferably in a range of from 20 to 80 μm.

In the above-described two-component developer, the mixing ratio (weight ratio) between the toner and the carrier (toner:carrier) is preferably in a range of from 1:100 to 30:100, and more preferably in a range of from 3:100 to 20:100.

Image Forming Apparatus

An image forming apparatus of an exemplary embodiment of the invention that uses the above-described developer of the present exemplary embodiment for developing an electrostatic charge image will be described below.

An image forming apparatus of an exemplary embodiment of the invention includes an image holding member; a developing unit that develops an electrostatic image formed on the image holding member as a toner image using a developer; a transfer unit that transfers the toner image formed on the image holding member to an image receiving member such as paper; and a fixing unit that fixes the toner image transferred to the image receiving member. Here, the developer of the present exemplary embodiment for developing an electrostatic charge image is used as the developer.

In the image forming apparatus, a portion including the developing unit may have a cartridge structure (process cartridge) that is detachably mounted on the main body of the image forming apparatus. As the process cartridge, a process cartridge including at least a developer holding member that contains the developer of the present exemplary embodiment for developing an electrostatic charge image is preferably be used.

Hereinafter, an example of the image forming apparatus of the exemplary embodiment of the invention is described, however the exemplary embodiment of the invention is not limited thereto. Only the main parts shown in the drawings will be described, and the descriptions of other parts will be omitted.

FIG. 1 is a diagram illustrating the schematic configuration of a four-drum tandem-type full color image forming apparatus. The image forming apparatus shown in FIG. 1 includes electrophotographic first to fourth image forming units 10Y, 10M, 10C, and 10K (image forming unit) that output images for yellow (Y), magenta (M), cyan (C), and black (K) on the basis of image data subjected to color separation, respectively. The image forming units (hereinafter, simply referred to as "unit") 10Y, 10M, 10C, and 10K are arranged in a horizontal direction at predetermined intervals. The units 10Y, 10M, 10C, and 10K may be a process cartridge that is detachably mounted on the main body of the image forming apparatus.

On the upper side (in terms of the direction of the drawing) of the units 10Y, 10M, 10C, and 10K, an intermediate transfer belt 20 as an intermediate transfer member extends over the units. The intermediate transfer belt 20 is wound around a driving roller 22 and a support roller 24, which are arranged apart from each other in the horizontal direction of the drawing, and the support roller 24 comes into contact with the inner surface of the intermediate transfer belt 20. The intermediate transfer belt 20 travels in a direction from the first unit 10Y toward the fourth unit 10K. The support roller 24 is urged by a spring and the like (not shown) in a direction distant from the driving roller 22, such that predetermined tension is applied to the intermediate transfer belt 20 wound around both rollers. Furthermore, an intermediate transfer member cleaning device 30 is provided to face the driving roller 22 at a side of the image holding member of the intermediate transfer belt 20.

Developing devices (developing units) 4Y, 4M, 4C, 4K corresponding to the units 10Y, 10M, 10C, and 10K are supplied with toners of four colors of yellow, magenta, cyan, and black, which are contained in toner cartridges 8Y, 8M, 8C, and 8K, respectively.

Each of the first to fourth units 10Y, 10M, 10C, and 10K have the similar configuration, and thus a description will be given for the first unit 10Y that is provided on an upstream side in the travel direction of the intermediate transfer belt to form a yellow image. The same parts as those of the first unit 10Y are represented by the same reference numerals but having different labels magenta (M), cyan (C), and black (K), instead of yellow (Y), and the descriptions of the second to fourth units 10M, 10C, and 10K will be omitted.

The first unit 10Y has a photoreceptor 1Y that functions as the image holding member. Around the photoreceptor 1Y are sequentially arranged a charging roller 2Y that charges the surface of the photoreceptor 1Y at a predetermined potential; an exposure device 3 that exposes the charged surface to a laser beam 3Y on the basis of an image signal subjected to color separation, to thereby form an electrostatic image; a developing device (developing unit) 4Y that supplies a charged toner to the electrostatic image and develops the electrostatic image; a primary transfer roller 5Y (primary transfer unit) that transfers the developed toner image to the intermediate transfer belt 20; and a photoreceptor cleaning device (cleaning unit) 6Y that removes the toner remaining on the surface of the photoreceptor 1Y after primary transfer.

The primary transfer roller 5Y is disposed inside the intermediate transfer belt 20, and is provided to face the photoreceptor 1Y. In addition, each of the primary transfer rollers 5Y, 5M, 5C, and 5K is connected to a primary bias power source (not shown) and is applied with a primary transfer bias therefrom. The bias power source changes the transfer bias to be applied to the corresponding primary transfer roller under the control of a control unit (not shown).

Hereinafter, the operation of the first unit 10Y to form the yellow image will be described. First, before the operation, the charging roller 2Y charges the surface of the photoreceptor 1Y at a potential of from about −600 V to about −800 V.

The photoreceptor 1Y is formed by laminating a photosensitive layer on a conductive base substance. The photosensitive layer usually has high resistance (resistance corresponding to general resins), however when the laser beam 3Y is irradiated, resistivity of a portion irradiated with the laser beam varies. The laser beam 3Y is output to the charged surface of the photoreceptor 1Y through the exposure device 3 according to image data for yellow from the control unit (not shown). The laser beam 3Y is irradiated onto the photosensitive layer on the surface of the photoreceptor 1Y, and accordingly, an electrostatic image having a yellow print pattern is formed on the surface of the photoreceptor 1Y.

The electrostatic image is an image that is formed on the surface of the photoreceptor 1Y by charging. Specifically, the electrostatic image is a so-called negative latent image that is formed as follows: the resistivity of an irradiated portion of the photosensitive layer is decreased by the laser beam 3Y, a charge on the surface of the photoreceptor 1Y flows while a charge in a portion not irradiated with the laser beam 3Y remains.

The electrostatic image formed on the photoreceptor 1Y in this manner is rotated to a predetermined development position as the photoreceptor 1Y travels. Then, at that development position, the electrostatic image on the photoreceptor 1Y becomes a visual image (developed image) by the developing device 4Y.

In the developing device 4Y a yellow toner is contained. The yellow toner is stirred in the developing device 4Y and frictionally charged, and is held on a developer roller (developer holding member) with a charge having the same polarity (negative) as the charge on the photoreceptor 1Y. Then, when the surface of the photoreceptor 1Y passes through the developing device 4Y, the yellow toner is electrostatically adhered to a neutralized latent image portion on the surface of the photoreceptor 1Y, and the latent image is developed by the yellow toner. The photoreceptor 1Y, on which the yellow toner image is formed, travels at a predetermined speed, and then the toner image developed on the photoreceptor 1Y is transferred to a predetermined primary transfer position.

When the yellow toner image on the photoreceptor 1Y is transferred to the primary transfer position, a predetermined primary transfer bias is applied to the primary transfer roller 5Y. Then, an electrostatic force from the photoreceptor 1Y toward the primary transfer roller 5Y acts on the toner image, and the toner image on the photoreceptor 1Y is transferred to the intermediate transfer belt 20. In this process, the applied transfer bias has a positive (+) polarity opposite to the polarity (−) of the toner. For example, the transfer bias of the first unit 10Y is controlled at approximately +10 μA by the control unit (not shown).

Meanwhile, the toner that remains on the photoreceptor 1Y is removed by the cleaning device 6Y and collected.

The primary transfer bias that is applied to the primary transfer rollers 5M, 5C, and 5K of the second units 10M, 10C, and 10K is controlled in the same manner as in the first unit.

In this manner, the intermediate transfer belt 20, to which the yellow toner image is transferred by the first unit 10Y, sequentially passes through the second to fourth units 10M, 10C, and 10K, such that the toner images for the individual colors are superposed and multiple transferred.

The intermediate transfer belt 20, to which the toner images for four colors are multiple transferred through the first to fourth units reaches a secondary transfer section. The secondary transfer section includes the intermediate transfer belt 20, the support roller 24 that comes into contact with the inner surface of the intermediate transfer belt 20, and a secondary transfer roller (secondary transfer unit) 26 that is arranged at a side of the image holding surface of the intermediate transfer belt 20. A recording paper (image receiving member) P is supplied to a gap between the secondary transfer roller 26 and the intermediate transfer belt 20 through a paper feed mechanism at a predetermined timing, and a predetermined secondary transfer bias is applied to the support roller 24. In this process, the applied transfer bias has a negative (−) polarity identical to the polarity (−) of the toner. An electrostatic force from the intermediate transfer belt 20 toward the recording paper P acts on the toner image, and the toner image on the intermediate transfer belt 20 is transferred to the recording paper P. The secondary transfer bias is determined depending on resistance detected by a resistance detection unit (not shown) of the second transfer section, and the voltage of the secondary transfer bias is controlled.

Subsequently, the recording paper P is forwarded to the fixing device (fixing unit) 28, the toner image is heated, and the color-superposed toner image is fused and fixed on the recording paper P. The recording paper P, on which a color image is fixed, is sent toward a discharge section, and then the color image forming operation is completed.

In the above-described image forming apparatus, the toner image is transferred to the recording paper P through the intermediate transfer belt 20. However, the exemplary embodiment of the invention is not limited thereto. For example, the toner image may be directly transferred from the photoreceptor to the recording paper.

In the image forming apparatus of the present exemplary embodiment, a fixing rate is preferably in a range of from 55 mm/s to 220 mm/s (or from about 55 mm/s to about 220 mm/s), and more preferably in a range of from 100 mm/s to 180 mm/s (or from about 100 mm/s to about 180 mm/s). Here, the fixing rate represents the velocity of a recording paper passing the fixing unit.

Process Cartridge and Toner Cartridge

Figure 2:
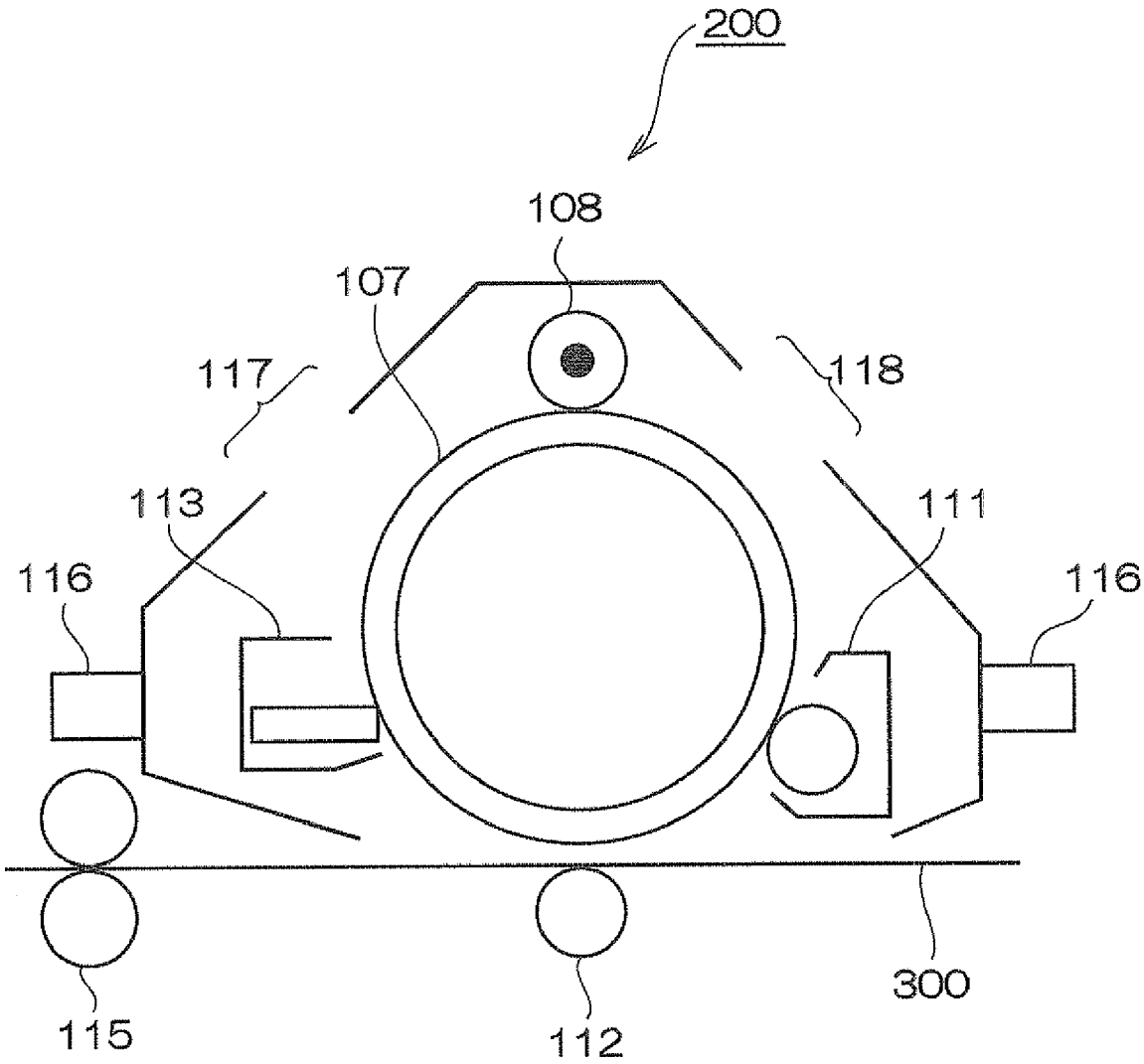
FIG. 2 is a schematic structural diagram illustrating an example of a process cartridge according to an exemplary embodiment.

FIG. 2 is a diagram showing the schematic configuration of a preferable example of a process cartridge that contains the developer of the present exemplary embodiment for developing an electrostatic charge image. A process cartridge 200 assembles a charging device 108, a developing device (developing unit) 111, a photoreceptor cleaning device (cleaning unit) 113, an opening 118 for exposure, and an opening 117 for neutralization exposure by using a mounting rail 116 to integrate, together with the photoreceptor 107.

The process cartridge 200 is detachable with respect to the main body of the image forming apparatus including a transfer device 112, a fixing device 115, and other components (not shown). The process cartridge 200 constitutes the image forming apparatus together with the main body of the image forming apparatus. Here, reference numeral 300 indicates a recording paper.

The process cartridge shown in FIG. 2 includes the charging device 108, the developing device 111, the cleaning device (cleaning unit) 113, the opening 118 for exposure, and the opening 117 for neutralization exposure. These devices may be select and used in combination. The process cartridge of the exemplary embodiment of the invention includes the photoreceptor 107, and at least one of the charging device 108, the developing device 111, the cleaning device (cleaning unit) 113, the opening 118 for exposure, and the opening 117 for neutralization exposure.

Next, a toner cartridge according to an exemplary embodiment of the invention will be described. The toner cartridge of the present exemplary embodiment is preferably a toner cartridge that is detachably mounted on the image forming apparatus, and contains at least a toner to be supplied to a developing unit in the image forming apparatus, in which the toner is the above-described toner of the present exemplary embodiment. The toner cartridge of the present exemplary embodiment may contain at least a toner, or may contain a developer depending on the configuration of the image forming apparatus.

In an image forming apparatus, on which a toner cartridge is detachably mounted, the toner cartridge that contains the toner of the present exemplary embodiment can be used, and, for example, in a compact toner cartridge, storage stability may be maintained and low-temperature fixing may be achieved while maintaining high image quality.

The image forming apparatus shown in FIG. 1 has the configuration on which the toner cartridges 8Y, 8M, 8C, and 8K are detachably mounted, and the developing devices 4Y, 4M, 4C, and 4K are connected to the corresponding toner cartridges through toner supply lines (not shown). When the toner contained in the toner cartridges is used up, the toner cartridges can be replaced.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

EXAMPLES

Hereinafter, the present invention will be explained with reference to examples in details, but the invention is not limited to these examples. In the following description, "part" and "%" are based on weight unless otherwise specified.

In the examples described below, a toner is prepared in the following manner. First, a resin dispersion liquid, a colorant dispersion liquid, and a releasing agent dispersion liquid described below are respectively prepared. Next, these liquids are mixed in a predetermined ratio and stirred, and a metal salt as a coagulant is added to the resultant mixture, thereby ionically neutralizing the charges of the particles and forming aggregates. Subsequently, pH of the system is shifted from mild acidity to neutral pH by adding an inorganic hydroxide, and then the system is heated at a temperature that is not less than the glass transition temperature of the resin particle, whereby each aggregate is fused and coalesced. After the reaction is completed, sufficient washing, solid-liquid separation, and drying processes are conducted, and desired toner particles are obtained. An external additive may be added to the obtained toner particles, whereby a final toner is obtained. Hereinafter, the above preparation methods will be explained in detail.

Measurement of Molecular Weight Distribution

The molecular weight distribution is measured by using a GPC apparatus (trade names: HLC-8120GPC and SC-8020, manufactured by Tosoh Corporation), columns (6.0 mmID× 15 cm×2) (trade names: TSK gel and Super HM-H, manufactured by Tosoh Corporation), and THF (tetrahydrofuran) for chromatography (manufactured by Wako Pure Chemical Industries, Ltd.) as an eluent. An experiment is conducted under the condition of a sample concentration: 0.5% by weight, a flow rate: 0.6 ml/min, a sample injection amount: 10 μl, and a measuring temperature: 40° C. The calibration curve is prepared using 10 samples: A-500, F-1, F-10, F-80, F-380, A-2500, F-4, F-40, F-128, and F-700. In the sample analysis, a data collection period is 300 ms.

Measurement of Glass Transition Temperature

The glass transition temperature (Tg) is obtained using a differential scanning calorimeter (trade name: DSC3110, manufactured by Mac Science Co., Ltd., thermal analysis system 001) (hereinafter, simply referred to as "DSC") by rising the temperature from 0° C. to 150° C. at a rate of 10° C./minute, holding the temperature at 150° C. for 5 minutes, falling the temperature from 150° C. to 0° C. using liquid nitrogen at a rate of −10° C./minute, holding the temperature at 0° C. for 5 minutes, and rising the temperature from 0° C. to 150° C. at a rate of 10° C./minute again. The glass transition temperature (Tg) is defined as an onset temperature that is analyzed from an endothermic curve during second temperature rising.

Measurement of Acid Value 1 g of the resin to be measured is weighed, and dissolved in 80 ml of tetrahydrofuran. A phenolphthalein indicator is added thereto as an indicator, and titration is performed using a 0.1 N solution of KOH in ethanol. The point at which the color of the indicator continues to be observed for 30 seconds is considered as the end point. The acid value (according to JIS K0070;92, which is the quantity (in terms of mg) of KOH required for neutralizing the free fatty acid contained in 1 g of the resin) is obtained by calculation based on the quantity of the added 0.1 N solution of KOH in ethanol.

Preparation of Noncrystalline Polyester Resin (1)

The following monomers are placed in a flask having an internal capacity of 5 L and equipped with a stirring device, a nitrogen introduction tube, a temperature sensor, and a rectification column:

Bisphenol A to which 2 mol of ethylene oxide has been added: 60% by mol

Bisphenol A to which 2 mol of propylene oxide has been added: 40% by mol

Dimethyl terephthalate: 65% by mol

Dodecenyl succinate: 30% by mol

Trimellitic acid: 5% by mol (The ratio (% by mol) of the compounds described above represents a ratio with respect to the total quantity of the type of component to which the monomer belongs (either the total quantity of the alcohol components or the total quantity of the acid components)).

The charged monomers are heated to 190° C. over 1 hour. After it is confirmed that the reaction system is uniformly stirred, 1.0% of dibutyltin oxide is poured in thereto. The temperature of the reaction system is increased from 190° C. to 240° C. over 6 hours while generated water is distilled off. A dehydration condensation reaction is further continued for 2 hours at 240° C., whereby a noncrystalline polyester resin (1) is obtained which has a glass transition temperature of 57.5° C., an acid value of 14.8 mgKOH/g, a weight average molecular weight of 35,000, and a number average molecular weight of 5,400.

Preparation of Crystalline Polyester Resin (a)

The following monomers and 0.3% of dibutyltin oxide (with respect to the total amount of the monomers), which is a catalyst, are added into a three-neck flask which has been dried by heating:

| | |
|---|---|
| Decanedicarboxylic acid | 100% by mol |
| Nonanediol | 100% by mol |

(The meaning of "% by mol" is as described in the preparation of noncrystalline polyester resin (1))

The air in the flask is substituted with an inactive atmosphere by replacement with nitrogen gas using a depressurizing operation. The contents of the flask are refluxed at 180° C. for 5 hours while stirring mechanically Then, the temperature is gradually increased to 230° C. under reduced pressure, and stirring is performed for 2 hours. When the contents of the flask become viscous, the contents are air-cooled to stop the reaction, whereby a crystalline polyester resin (a) is synthesized. The crystalline polyester resin (a) has an acid value of 13.5 mgKOH/g, and, as a result of (polystyrene-equivalent) molecular weight measurement using gel permeation chromatography, the crystalline polyester resin (a) is found to have a weight average molecular weight (Mw) of 23,300 and a number average molecular weight (Mn) of 7,300.

As a result of a measurement of the melting temperature (Tm) of the crystalline polyester resin (a) with a differential scanning calorimeter (DSC) by the measurement method described above, the crystalline polyester resin (a) shows a definite endothermic peak, and the endothermic peak temperature is found to be 72.2° C.

Preparation of Noncrystalline Polyester Resin Dispersion Liquid (1)

50 parts of methyl ethyl ketone and 30 parts of isopropyl alcohol are added into a 2 L separable flask equipped with a four-bladed propeller that applies a stirring force. 100 parts of the noncrystalline polyester resin (1) are gradually added and dissolved while stirring the contents of the flask and maintaining the temperature of the reaction system at 50° C. by heating. Then, 5 parts of 25% aqueous ammonia are added thereto, and ion-exchanged water is added dropwise to emulsify. Solvents are removed from the emulsion liquid under reduced pressure using an evaporator, whereby a noncrystalline polyester resin dispersion liquid (1) containing particles with a volume average particle diameter of 160 nm is obtained. Since water is evaporated and the solid content is increased during the depressurization using the evaporator, the depressurization is stopped at suitable time points and distilled water is added to adjust the solid content to 20%. The contents of the organic solvents contained in the noncrystalline polyester resin dispersion liquid (1) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (1) are found to be 500 ppm and 1,000 ppm, respectively.

Preparation of Noncrystalline Polyester Resin Dispersion Liquid (2)

The noncrystalline polyester resin (1) is dissolved in a mixed solvent of methyl ethyl ketone (MEK) and isopropyl alcohol (IPA) in a ratio by weight of 1.5:1 (MEK:IPA). Then, the solution is subjected to drying at 45° C. in an explosion-proof drying machine until the solid content becomes 95%. The resin is then dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, the dispersion liquid is subjected to evaporation under reduced pressure, whereby a noncrystalline polyester resin dispersion liquid (2) having a volume average particle diameter of 260 nm is obtained. Since water evaporates and the solid content increases during the evaporation the evaporation operation is stopped at suitable time points and distilled water is added so as to adjust the solid content to 20%. The amounts of the organic solvents contained in the noncrystalline polyester resin dispersion liquid (2) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (2) are found to be 350 ppm and 270 ppm, respectively.

Preparation of Noncrystalline Polyester Resin Dispersion Liquid (3)

60 parts of methyl ethyl ketone and 20 parts of isopropyl alcohol are added into a 2 L separable flask equipped with a four-bladed propeller that applies a stirring force. 100 parts of the noncrystalline polyester resin (1) are gradually added and dissolved while stirring the contents of the flask and maintaining the temperature of the reaction system at 50° C. by heating. Then, 5 parts of 25% aqueous ammonia are added thereto, and ion-exchanged water is added dropwise to emulsify. Solvents are removed from the emulsion liquid under reduced pressure using an evaporator, whereby a noncrystalline polyester resin dispersion liquid (3) containing particles with a volume average particle diameter of 185 nm is obtained. Since water is evaporated and the solid content is increased during the depressurization using the evaporator, the depressurization is stopped at suitable time points and distilled water is added to adjust the solid content to 20%. The contents of the organic solvents contained in the noncrystalline polyester resin dispersion liquid (3) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (3) are found to be 40 ppm and 150 ppm, respectively.

Preparation of Noncrystalline Polyester Resin Dispersion Liquid (4)

40 parts of methyl ethyl ketone and 10 parts of isopropyl alcohol are added into a 2 L separable flask equipped with a four-bladed propeller that applies a stirring force. 100 parts of the noncrystalline polyester resin (1) are gradually added and dissolved while stirring the contents of the flask and maintaining the temperature of the reaction system at 50° C. by heating. Then, 5 parts of 25% aqueous ammonia are added thereto, and ion-exchanged water is added dropwise to emulsify. Solvents are removed from the emulsion liquid under reduced pressure using an evaporator, whereby a noncrystalline polyester resin dispersion liquid (4) containing particles with a volume average particle diameter of 205 nm is obtained. Since water is evaporated and the solid content is increased during the depressurization using the evaporator, the depressurization is stopped at suitable time points and distilled water is added to adjust the solid content to 20%. The contents of the organic solvents contained in the noncrystalline polyester resin dispersion liquid (4) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (4) are found to be 0 ppm and 10 ppm, respectively.

Preparation of Noncrystalline Polyester Resin Dispersion Liquid (5)

The noncrystalline polyester resin (1) is dispersed using a disperser obtained by modifying a CAVITRON CD1010 (trade name: manufactured by Eurotec Ltd.) so as to be adapted to high-temperature high-pressure processing. Specifically, a liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the liquid is adjusted to 8.5 with ammonia, and the liquid is dispersed using the modified CAVITRON CD1010 under the conditions of a rotation speed of the rotor of 60 Hz, a pressure of 5 kg/cm$^2$, and a heating temperature of a heat-exchanger of 140° C., whereby a noncrystalline polyester resin dispersion liquid (5) having a volume average particle diameter of 240 nm is obtained. The amounts of the organic solvents contained in the noncrystalline polyester resin dispersion liquid (5) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (5) are found to be 0 ppm and 0 ppm, respectively.

Preparation of Noncrystalline Polyester Resin Dispersion Liquid (6)

80 parts of methyl ethyl ketone and 40 parts of isopropyl alcohol are added into a 2 L separable flask equipped with a four-bladed propeller that applies a stirring force. 100 parts of the noncrystalline polyester resin (1) are gradually added and dissolved while stirring the contents of the flask and maintaining the temperature of the reaction system at 50° C. by heating. Then, 10 parts of 25% aqueous ammonia are added thereto, and ion-exchanged water is added dropwise to emulsify. Solvents are removed from the emulsion liquid under reduced pressure using an evaporator, whereby a noncrystalline polyester resin dispersion liquid (6) containing particles with a volume average particle diameter of 180 nm is obtained. Since water is evaporated and the solid content is increased during the depressurization using the evaporator, the depressurization is stopped at suitable time points and distilled water is added to adjust the solid content to 20%. The contents of the organic solvents contained in the noncrystalline polyester resin dispersion liquid (6) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (6) are found to be 2,000 ppm and 5,000 ppm, respectively.

Preparation of Noncrystalline Polyester Resin Dispersion Liquid (7)

The noncrystalline polyester resin (1) is dissolved in methyl ethyl ketone. Then, the solution is subjected to drying at 45° C. in an explosion-proof drying machine until the solid content becomes 95%. The resin is then dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, the dispersion liquid is subjected to evaporation under reduced pressure, whereby a noncrystalline polyester resin dispersion liquid (7) having a volume average particle diameter of 220 nm is obtained. Since water evaporates and the solid content increases during the evaporation, the evaporation operation is stopped at suitable time points and distilled water is added so as to adjust the solid content to 20%. The amounts of the organic solvents contained in the noncrystalline polyester resin dispersion liquid (7) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (7) are found to be 450 ppm and 0 ppm, respectively.

Preparation of Noncrystalline Polyester Resin Dispersion Liquid (8)

The noncrystalline polyester resin (1) is dispersed using a disperser obtained by modifying a CAVITRON CD1010

(trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, 1% (with respect to the noncrystalline resin) of isopropyl alcohol is added thereto, and then the dispersion liquid is subjected to evaporation under reduced pressure, whereby a noncrystalline polyester resin dispersion liquid (8) having a volume average particle diameter of 190 nm is obtained. Since water evaporates and the solid content increases during the evaporation, the evaporation operation is stopped at suitable time points and distilled water is added so as to adjust the solid content to 20%. The amounts of the organic solvents contained in the noncrystalline polyester resin dispersion liquid (8) are measured using a gas chromatograph in a manner similar to the above-described measurement of the contents of the organic solvents contained in toner particle dispersion liquids. As a result, the amounts of MEK and IPA contained in the noncrystalline polyester resin dispersion liquid (8) are found to be 0 ppm and 610 ppm, respectively.

Preparation of Noncrystalline Polyester Resin Dispersion Liquid (9)

The noncrystalline polyester resin (1) is dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, 1% (with respect to the noncrystalline resin) of acetone and 1% (with respect to the noncrystalline resin) of isopropyl alcohol is added thereto, and then the dispersion liquid is subjected to evaporation under reduced pressure, whereby a noncrystalline polyester resin dispersion liquid (9) having a volume average particle diameter of 190 nm is obtained. Since water evaporates and the solid content increases during the evaporation, the evaporation operation is stopped at suitable time points and distilled water is added so as to adjust the solid content to 20%. The amounts of the organic solvents contained in the noncrystalline polyester resin dispersion liquid (9) are measured using a gas chromatograph in a manner similar to the above-described measurement of the contents of the organic solvents contained in toner particle dispersion liquids. As a result, the amounts of acetone and IPA contained in the noncrystalline polyester resin dispersion liquid (9) are found to be 250 ppm and 420 ppm, respectively.

Preparation of Noncrystalline Polyester Resin Dispersion Liquid (10)

The noncrystalline polyester resin (1) is dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water 1% (in terms of the amount of an effective component) of an anionic surfactant (trade name: NEOGEN RK, manufactured by Dai-ichi Kogyo Seiyaku Co., Ltd.), and 20% of the noncrystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, 1% (based on the amount of the noncrystalline resin) of methyl ethyl ketone and 1% (with respect to the noncrystalline resin) of ethanol is added thereto, and then the dispersion liquid is subjected to evaporation under reduced pressure, whereby a noncrystalline polyester resin dispersion liquid (10) having a volume average particle diameter of 190 nm is obtained. Since water evaporates and the solid content increases during the evaporation, the evaporation operation is stopped at suitable time points and distilled water is added so as to adjust the solid content to 20%. The amounts of the organic solvents contained in the noncrystalline polyester resin dispersion liquid (10) are measured using a gas chromatograph in a manner similar to the above-described measurement of the contents of the organic solvents contained in toner particle dispersion liquids. As a result, the amounts of MEK and ethanol contained in the noncrystalline polyester resin dispersion liquid (10) are found to be 280 ppm and 250 ppm, respectively.

Preparation of Crystalline Polyester Resin Dispersion Liquid (1)

60 parts of methyl ethyl ketone and 50 parts of isopropyl alcohol are added into a 2 L separable flask equipped with a four-bladed propeller that applies a stirring force. 100 parts of the crystalline polyester resin (a) are gradually added and dissolved while stirring the contents of the flask and maintaining the temperature of the reaction system at 65° C. by heating. Then, 15 parts of 25% aqueous ammonia are added thereto, and ion-exchanged water is added dropwise to emulsify. Solvents are removed from the emulsion liquid under reduced pressure using an evaporator, whereby a crystalline polyester resin dispersion liquid (1) containing particles with a volume average particle diameter of 280 nm is obtained. Since water is evaporated and the solid content is increased during the depressurization using the evaporator, the depressurization is stopped at suitable time points and distilled water is added to adjust the solid content to 20%. The contents of the organic solvents contained in the crystalline polyester resin dispersion liquid (1) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (1) are found to be 300 ppm and 650 ppm, respectively.

Preparation of Crystalline Polyester Resin Dispersion Liquid (2)

The crystalline polyester resin (a) is dissolved in a mixed solvent of methyl ethyl ketone (MEK) and isopropyl alcohol (IPA) in a ratio by weight of 1.5:1 (MEK:IPA). Then, the solution is subjected to drying at 45° C. in an explosion-proof drying machine until the solid content becomes 95%. The resin is then dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the crystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, the dispersion liquid is subjected to evaporation under reduced pressure, whereby a crystalline polyester resin dispersion liquid (2) having a volume average particle diameter of 275 nm is obtained. Since water evaporates and the solid content increases during the evaporation, the evaporation operation is stopped at suitable time points and distilled water is added so as to adjust the solid content to 20%. The amounts of the organic solvents contained in the crystalline polyester resin dispersion liquid (2) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (2) are found to be 210 ppm and 180 ppm, respectively.

Preparation of Crystalline Polyester Resin Dispersion Liquid (3)

50 parts of methyl ethyl ketone and 15 parts of isopropyl alcohol are added into a 2 L separable flask equipped with a four-bladed propeller that applies a stirring force. 100 parts of the crystalline polyester resin (a) are gradually added and dissolved while stirring the contents of the flask and maintaining the temperature of the reaction system at 65° C. by heating. Then, 15 parts of 25% aqueous ammonia are added thereto, and ion-exchanged water is added dropwise to emulsify. Solvents are removed from the emulsion liquid under reduced pressure using an evaporator, whereby a crystalline polyester resin dispersion liquid (3) containing particles with a volume average particle diameter of 200 nm is obtained. Since water is evaporated and the solid content is increased during the depressurization using the evaporator, the depressurization is stopped at suitable time points and distilled water is added to adjust the solid content to 20%. The contents of the organic solvents contained in the crystalline polyester resin dispersion liquid (3) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (3) are found to be 35 ppm and 100 ppm, respectively.

Preparation of Crystalline Polyester Resin Dispersion Liquid (4)

50 parts of methyl ethyl ketone and 15 parts of isopropyl alcohol are added into a 2 L separable flask equipped with a four-bladed propeller that applies a stirring force. 100 parts of the crystalline polyester resin (a) are gradually added and dissolved while stirring the contents of the flask and maintaining the temperature of the reaction system at 65° C. by heating. Then, 15 parts of 25% aqueous ammonia are added thereto, and ion-exchanged water is added dropwise to emulsify. Solvents are removed from the emulsion liquid under reduced pressure using an evaporator, whereby a crystalline polyester resin dispersion liquid (4) containing particles with a volume average particle diameter of 205 nm is obtained. Since water is evaporated and the solid content is increased during the depressurization using the evaporator, the depressurization is stopped at suitable time points and distilled water is added to adjust the solid content to 20%. The contents of the organic solvents contained in the crystalline polyester resin dispersion liquid (4) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (4) are found to be 0 ppm and 125 ppm, respectively.

Preparation of Crystalline Polyester Resin Dispersion Liquid (5)

The crystalline polyester resin (a) is dispersed using a disperser obtained by modifying a CAVITRON CD1010 (trade name: manufactured by Eurotec Ltd.) so as to be adapted to high-temperature high-pressure processing. Specifically, a liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the crystalline resin. The pH of the liquid is adjusted to 8.5 with ammonia, and the liquid is dispersed using the modified CAVITRON CD1010 under the conditions of a rotation speed of the rotor of 60 Hz, a pressure of 5 kg/cm$^2$, and a heating temperature of a heat-exchanger of 140° C., whereby a crystalline polyester resin dispersion liquid (5) having a volume average particle diameter of 220 nm is obtained. The amounts of the organic solvents contained in the crystalline polyester resin dispersion liquid (5) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (5) are found to be 0 ppm and 0 ppm, respectively.

Preparation of Crystalline Polyester Resin Dispersion Liquid (6)

80 parts of methyl ethyl ketone and 80 parts of isopropyl alcohol are added into a 2 L separable flask equipped with a four-bladed propeller that applies a stirring force. 100 parts of the crystalline polyester resin (a) are gradually added and dissolved while stirring the contents of the flask and maintaining the temperature of the reaction system at 65° C. by heating. Then, 15 parts of 25% aqueous ammonia are added thereto, and ion-exchanged water is added dropwise to emulsify. Solvents are removed from the emulsion liquid under reduced pressure using an evaporator, whereby a crystalline polyester resin dispersion liquid (6) containing particles with a volume average particle diameter of 250 nm is obtained. Since water is evaporated and the solid content is increased during the depressurization using the evaporator, the depressurization is stopped at suitable time points and distilled water is added to adjust the solid content to 20%. The contents of the organic solvents contained in the crystalline polyester resin dispersion liquid (6) are measured using a gas chromatograph in a manner similar to the above-described measurement of the contents of the organic solvents contained in toner particle dispersion liquids. As a result, the amounts of MEK and IPA contained in the crystalline polyester resin dispersion liquid (6) are found to be 2,000 ppm and 6,000 ppm, respectively.

Preparation of Crystalline Polyester Resin Dispersion Liquid (7)

The crystalline polyester resin (a) is dissolved in a mixed solvent of acetone and isopropyl alcohol (IPA) in a ratio by weight of 1.5:1 (acetone:IPA). Then, the solution is subjected to drying at 45° C. in an explosion-proof drying machine until the solid content becomes 95%. The resin is then dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the crystalline resin.

The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, the dispersion liquid is subjected to evaporation under reduced pressure, whereby a crystalline polyester resin dispersion liquid (7) having a volume average particle diameter of 242 nm is obtained. Since water evaporates and the solid content increases during the evaporation, the evaporation operation is stopped at suitable time points and distilled water is added so as to adjust the solid content to 20%. The amounts of the organic solvents contained in the crystalline polyester resin dispersion liquid (7) are measured using a gas chromatograph in a manner similar to the above-described measurement of the contents of the organic solvents contained in toner particle dispersion liquids. As a result, the amounts of acetone and IPA contained in the crystalline polyester resin dispersion liquid (7) are found to be 110 ppm and 190 ppm, respectively.

Preparation of Crystalline Polyester Resin Dispersion Liquid (8)

The crystalline polyester resin (a) is dissolved in a mixed solvent of methyl ethyl ketone (MEK) and ethanol in a ratio by weight of 1.5:1 (MEK:ethanol). Then, the solution is subjected to drying at 45° C. in an explosion-proof drying machine until the solid content becomes 95%. The resin is then dispersed using a disperser obtained by modifying a CAVITRON CD1010 (trade name: manufactured by Eurotec Ltd.) so as to be adapted to high-temperature high-pressure processing. Specifically, a mixture liquid is prepared having a composition of 79% of ion-exchanged water, 1% (in terms of the amount of an effective component) of an anionic surfactant (trade name: NEOGEN RK, manufactured by Dai-ichi Kogyo Seiyaku Co., Ltd.), and 20% of the crystalline resin. The pH of the mixture liquid is adjusted to 8.5 with ammonia, and the mixture liquid is dispersed using the modified CAVITRON CD1010 under the conditions of a rotation speed of the rotor of 60 Hz, a pressure of 5 kg/cm$^2$, and a heating temperature of a heat-exchanger of 140° C. Thereafter, the dispersion liquid is subjected to evaporation under reduced pressure, whereby a crystalline polyester resin dispersion liquid (8) having a volume average particle diameter of 245 nm is obtained. Since water evaporates and the solid content increases during the evaporation, the evaporation operation is stopped at suitable time points and distilled water is added so as to adjust the solid content to 20%. The amounts of the organic solvents contained in the crystalline polyester resin dispersion liquid (8) are measured using a gas chromatograph in a manner similar to the above-described measurement of the contents of the organic solvents contained in toner particle dispersion liquids. As a result, the amounts of MEK and ethanol contained in the crystalline polyester resin dispersion liquid (8) are found to be 150 ppm and 80 ppm, respectively.

Preparation of Colorant Dispersion Liquid (1)

20 parts of a cyan pigment (trade name: ECB-301, manufactured by Dainichiseika Color and Chemicals Manufacturing Co., Ltd.), 2 parts of an anionic surfactant (trade name: NEOGEN SC, manufactured by Dai-ichi Kogyo Seiyaku Co., Ltd., in an amount (in terms of the amount of effective component) of 10% with respect to the colorant), and 78 parts of water are poured into a stainless-steel container of such a size that the liquid level is about one-third of the height of the container when all of the above ingredients are poured in thereto. The liquid in the container is dispersed at 5,000 rpm for 5 minutes using a homogenizer (trade name: ULTRA-TURRAX T50, manufactured by IKA Japan K.K.), and is defoamed by being stirred with a stirring device for one day. Then, the dispersion liquid is dispersed at a pressure of 240 MPa using a high-pressure impact-type disperser ALTIMIZER (trade name: HJP30006, manufactured by Sugino Machine Co., Ltd.). The dispersing corresponds to dispersing for 25 paths as calculated from the total charging amount and the processing performance of the apparatus. Thereafter, ion-exchanged water is added thereto, thereby adjusting the solid content to 16.5%. The volume average particle diameter (D50) of the particles contained in the colorant particle dispersion liquid is measured with a MICROTRAC UPA (trade name: manufactured by Nikkiso Co., Ltd.) and found to be 115 nm.

Preparation of Releasing Agent Dispersion Liquid

The following components are sufficiently dispersed at 95° C. under heating, using a homogenizer (trade name: ULTRA-TURRAX T50, manufactured by IKA Japan K.K.):

Polyalkylene wax (trade name: HNP-9, manufactured by Nippon Seiro Co., Ltd. and having a melting temperature of 78° C. and a viscosity of 2.5 mPa·s at 180° C.): 270 parts Anionic surfactant (trade name: NEOGEN RK, manufactured by Dai-ichi Kogyo Seiyaku Co., Ltd.): 8.4 parts (the amount of effective component being 3.0% with respect to the amount of the releasing agent)

Ion-exchanged water: 720 parts

The obtained dispersion is further dispersed at a dispersing pressure of 500 kg/cm$^2$ using a pressure-discharge-type homogenizer (a Gaulin homogenizer manufactured by APV Gaulin Inc.) for such a period of time that the dispersing corresponds to dispersing for 10 paths as calculated from the charging amount and the dispersing performance of the apparatus, whereby a releasing agent dispersion liquid is obtained. The volume average particle diameter D50 of the releasing agent particles is 225 nm. Thereafter, ion-exchanged water is added so as to adjust the solid content to 25.8%.

Example 1

Preparation of Toner Particles (1)

The following components are added into a 3 L reaction vessel equipped with a thermometer, a pH meter, and a stirrer:

Ion-exchanged water: 400 parts

Crystalline polyester resin dispersion liquid (1) (containing the crystalline polyester resin at a concentration of 20%): 50 parts Noncrystalline polyester resin dispersion liquid (1) (containing the noncrystalline polyester resin at a concentration of 20%): 250 parts Anionic surfactant (trade name: NEOGEN RK, manufactured by Dai-ichi Kogyo Seiyaku Co., Ltd. and having an effective component content of 60%): 2.5 parts The contents of the reaction vessel are maintained at 30° C. for 30 minutes while stirring the contents at 150 rpm and regulating the temperature from outside using a mantle heater.

Thereafter, the following components are added thereto:

Colorant Dispersion Liquid (1) (having a colorant concentration of 15%): 47 parts Releasing Agent Dispersion Liquid (having a releasing agent concentration of 25%): 32 parts The contents of the reaction vessel are maintained in the above-described temperature and stirring conditions for 5 minutes. 1.0% aqueous nitric acid solution is added thereto to adjust the pH to 2.7 while the above-described temperature and stirring conditions are maintained. Thereafter, the stirring device and the mantle heater are removed. Then, while the contents of the reaction vessel are dispersed at 3,000 rpm using a homogenizer (trade name: ULTRA-TURRAX T50, manufactured by IKA Japan K.K.), a mixture liquid of 0.5 parts of poly(aluminum chloride) and 37.5 parts of a 0.1% aqueous nitric acid solution is added thereto in the following manner: a half (in terms of weight) of the mixed liquid is added first, and then the dispersing rotation number is changed to 5,000 rpm and the other half of the mixed liquid is added over one minute, and then the dispersing rotation number is changed to 6,500 rpm and dispersing is further performed for 6 minutes.

The stirring device and the mantle heater are attached to the reaction vessel. Then, while the rotation number of the stirring device is so adjusted as to sufficiently stir the slurry, the temperature is increased to 42° C. at a rate of 0.5° C./min., maintained at 42° C. for 15 minutes, and increased at a rate of 0.1° C./min. during which the particle diameter is measured every 10 minutes with a Coulter MULTISIZER II (trade name, manufactured by Beckman Coulter Inc. and having an aperture diameter of 50 μm) at a measurement concentration of 10% using ISOTON (trade name, manufactured by Beckman Coulter Inc.) as a diluent. When the volume average particle diameter reaches 5.0 μm, 125 parts of the noncrystalline polyester resin dispersion liquid (1) are added. The temperature is maintained for 30 minutes after the addition of the noncrystalline polyester resin dispersion liquid, and then the pH of the dispersion liquid is adjusted to 9.0 using a 5% aqueous sodium hydroxide solution. Thereafter, the temperature is increased to 90° C. at a temperature increase rate of 1° C./min. while the pH is adjusted to 9.0 every time the temperature is increased by 5° C. The resultant reaction liquid is maintained at 90° C. for 2 hours, and then the temperature thereof is decreased to 20° C. at a rate of 1° C./min., thereby solidifying the particles and providing a toner particle dispersion liquid.

Thereafter, the toner particle dispersion liquid is filtrated, and then washed with running ion-exchanged water. When the conductivity of the filtrate becomes 30 mS or less, particles in the form of a cake are extracted, added to ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried using a flash dryer, wherein the dry air quantity and the hot air temperature at the inlet are regulated such that the temperature at the outlet of the flash dryer is 45° C. As a result, toner particles (1) are obtained.

The obtained toner particles (1) have a volume average particle diameter (D50) of 6.2 μm, a GSD (vol.) of 1.22, and a shape factor SF1 of 133 as determined by observation of the particle shape under a LUZEX FT (trade name, manufactured by Nireco Corporation). When a water dispersion supernatant liquid of the toner particles (1) is prepared as described above, the methyl ethyl ketone concentration in the water dispersion supernatant liquid is 2 ppm when measured by the above-described method, the isopropyl alcohol concentration in the water dispersion supernatant liquid is 7 ppm when measured by the above-described method, and the total concentration of methyl ethyl ketone and isopropyl alcohol in the water dispersion supernatant liquid is 9 ppm. When a DMF dissolution supernatant liquid of the toner particles (1) is prepared as described above, the concentration of methyl ethyl ketone in the DMF dissolution supernatant liquid is 6 ppm, the concentration of isopropyl alcohol in the DMF dissolution supernatant liquid is 15 ppm, and the total concentration of methyl ethyl ketone and isopropyl alcohol in the DMF dissolution supernatant liquid is 21 ppm.

The GSD (vol.) is measured as follows.

Divided particle diameter ranges are set such that the particle diameter range of from 1.26 μm to 50.8 μm is divided into 16 channels at an interval of 0.1 in terms of the logarithmic value of the particle diameter corresponding to each channel. Specifically, Channel 1 corresponds to a particle diameter of from 1.26 μm to less than 1.59 μm, Channel 2 corresponds to a particle diameter of from 1.59 μm to less than 2.00 μm, Channel 3 corresponds to a particle diameter of from 2.00 μm to less than 2.52 μm and so on, whereby the logarithmic value of the lower limit particle diameter of Channel 1 (log 1.26) is 0.1, the logarithmic value of the lower limit particle diameter of Channel 2 (log 1.59) is 0.2, the logarithmic value of the lower limit particle diameter of Channel 3 (log 2.00) is 0.3 and so on, and the logarithmic value of the lower limit particle diameter of Channel 16 is 1.6. A cumulative particle number distribution curve and a cumulative particle volume distribution curve are drawn from the smaller particle diameter side, based on the particle diameter distribution measured with a Coulter MULTISIZER II and classified into the respective channels. The particle diameter at which the cumulative particle number distribution curve reaches 16% of the total number of the particles is defined as D16(pop.), the particle diameter at which the cumulative particle number distribution curve reaches 50% of the total number of the particles is defined as D50(pop.), and the particle diameter at which the cumulative particle number distribution curve reaches 84% of the total number of the particles is defined as D84(pop.). Similarly, the particle diameter at which the cumulative particle volume distribution curve reaches 16% of the total volume of the particles is defined as D16(vol.), the particle diameter at which the cumulative particle volume distribution curve reaches 50% of the total volume of the particles is defined as D50(vol.), and the particle diameter at which the cumulative particle volume distribution curve reaches 84% of the total volume of the particles is defined as D84(vol.). The volume particle diameter distribution index GSD(vol.) is calculated from the expression, $GSD(vol.)=(D84(vol.)/D16(vol.))^{1/2}$.

The shape factor SF1 is calculated according to the following expression:

$$SF1=((\text{the absolute maximum length of a toner particle})^2/(\text{the projection area of the toner particle}))\times(\pi/4)\times 100$$

The absolute maximum length of the toner particle and the projection area of the toner particle are obtained using a LUZEX FT.

Production of Toner (1) Carrying External Additives 100 parts of the obtained toner particles are blended with 1.5 parts of a hydrophobic silica (trade name: RY50, manufactured by Nippon Aerosil Co., Ltd.) and 1.0 parts of a hydrophobic titanium oxide (trade name: T805, manufactured by Nippon Aerosil Co., Ltd.) at 10,000 rpm for 45 seconds using a sample mill. Thereafter, the toner particles carrying the external additives are sieved through a vibration sieve having a mesh of 45 μm, whereby a toner (1) is produced.

Example 2

Preparation, of Toner Particles (2)

Toner particles (2) are prepared in the same manner as the preparation of toner particles (1) in Example 1 except that the crystalline polyester resin dispersion liquid (2) and the noncrystalline polyester resin dispersion liquid (2) are used in place of the crystalline polyester resin dispersion liquid (1) and the noncrystalline polyester resin dispersion liquid (1), respectively, of Example 1.

The obtained toner particles (2) have a volume average particle diameter (DS50) of 6.3 μm, a GSD (vol.) of 1.23, and a shape factor SF1 of 128 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 5 ppm when measured by the above-described method, the isopropyl alcohol concentration in the water dispersion supernatant liquid is 3 ppm when measured by the above-described method, and the total concentration of methyl ethyl ketone and isopropyl alcohol in the water dispersion supernatant liquid is 8 ppm. When a DMF dissolution supernatant liquid of the toner particles (2) is prepared as described above, the concentration of methyl ethyl ketone in the DMF dissolution supernatant liquid is 15 ppm, the concentration of isopropyl alcohol in the DMF dissolution supernatant liquid is 8 ppm, and the total concentration of methyl ethyl ketone and isopropyl alcohol in the DMF dissolution supernatant liquid is 23 ppm.

Toner (2) carrying external additives is prepared in the same manner as the preparation of toner particles (1) carrying external additives in Example 1 except that the toner particles (2) are used in place of the toner particles (1) of Example 1.

Example 3

Preparation of Toner Particles (3)

Toner particles (3) are prepared in the same manner as the preparation of toner particles (1) in Example 1 except that the crystalline polyester resin dispersion liquid (3) and the noncrystalline polyester resin dispersion liquid (3) are used in place of the crystalline polyester resin dispersion liquid (1) and the noncrystalline polyester resin dispersion liquid (1), respectively, of Example 1.

The obtained toner particles (3) have a volume average particle diameter (D50) of 5.8 μm, a GSD (vol.) of 1.24, and a shape factor SF1 of 133 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 1 ppm when measured by the above-described method, the isopropyl alcohol concentration in the water dispersion supernatant liquid is 5 ppm when measured by the above-described method, and the total concentration of methyl ethyl ketone and isopropyl alcohol in the water dispersion supernatant liquid is 6 ppm. When a DMF dissolution supernatant liquid of the toner particles (3) is prepared as described above, the concentration of methyl ethyl ketone in the DMF dissolution supernatant liquid is 3 ppm, the concentration of isopropyl alcohol in the DMF dissolution supernatant liquid is 8 ppm, and the total concentration of methyl ethyl ketone and isopropyl alcohol in the DMF dissolution supernatant liquid is 11 ppm.

Toner (3) carrying external additives is prepared in the same manner as the preparation of toner (1) carrying external additives in Example 1 except that the toner particles (3) are used in place of the toner particles (1) of Example 1.

Example 4

Preparation of Toner Particles (4)

The following components are added into a 3 L reaction vessel equipped with a thermometer, a pH meter, and a stirrer:

Ion-exchanged water: 400 parts

Crystalline polyester resin dispersion liquid (6) (containing the crystalline polyester resin at a concentration of 20%): 50 parts Noncrystalline polyester resin dispersion liquid (6) (containing the noncrystalline polyester resin at a concentration of 20%): 250 parts Anionic surfactant (trade name: NEOGEN RK, manufactured by Dai-ichi Kogyo Seiyaku Co., Ltd. and having an effective component content of 60%): 2.5 parts The contents of the reaction vessel are maintained at 30° C. for 30 minutes while stirring the contents at 150 rpm and regulating the temperature from outside using a mantle heater.

Thereafter, the following components are added thereto.

Colorant Dispersion Liquid (1) (having a colorant concentration of 15%): 47 parts Releasing Agent Dispersion Liquid (having a releasing agent concentration of 25%): 32 parts The contents of the reaction vessel are maintained in the above-described temperature and stirring conditions for 5 minutes. 1.0% aqueous nitric acid solution is added thereto to adjust the pH to 2.7 while the above-described temperature and stirring conditions are maintained. Thereafter, the stirring device and the mantle heater are removed. Then, while the contents of the reaction vessel are dispersed at 3,000 rpm using a homogenizer (trade name: ULTRA-TURRAX T50, manufactured by IKA Japan K.K.), a mixture liquid of 0.5 parts of poly(aluminum chloride) and 37.5 parts of a 0.1% aqueous nitric acid solution is added thereto in the following manner: a half (in terms of weight) of the mixed liquid is added first, and then the dispersing rotation number is changed to 5,000 rpm and the other half of the mixed liquid is added over one minute, and then the dispersing rotation number is changed to 6,500 rpm and dispersing is further performed for 6 minutes.

The stirring device and the mantle heater are attached to the reaction vessel. Then, while the rotation number of the stirring device is so adjusted as to sufficiently stir the slurry, the temperature is increased to 42° C. at a rate of 0.5° C./min., maintained at 42° C. for 15 minutes, and increased at a rate of 0.1° C./min. during which the particle diameter is measured every 10 minutes with a Coulter MULTISIZER II (trade name, manufactured by Beckman Coulter Inc. and having an aperture diameter of 50 μm) at a measurement concentration of 10% using ISOTON (trade name, manufactured by Beckman Coulter Inc.) as a diluent. When the volume average particle diameter reaches 5.0 μm, 125 parts of the noncrystalline polyester resin dispersion liquid (6) are added. The temperature is maintained for 30 minutes after the addition of the noncrystalline polyester resin dispersion liquid, and then the pH of the dispersion liquid is adjusted to 9.0 using a 5% aqueous sodium hydroxide solution. Thereafter, the temperature is increased to 90° C. at a temperature increase rate of 1° C./min. while the pH is adjusted to 9.0 every time the temperature is increased by 5° C. The resultant reaction liquid is maintained at 90° C. for 2 hours, and then the temperature thereof is decreased to 20° C. at a rate of 1° C./min., thereby solidifying the particles and providing a toner particle dispersion liquid.

Thereafter, the toner particle dispersion liquid is filtrated, and then washed with running ion-exchanged water. When the conductivity of the filtrate becomes 30 mS or less, particles in the form of a cake are extracted, added to ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried in an oven at 25° C. for 24 hours. The dried particles are pulverized with a sample mill, and are dried again in an oven at 25° C. for 24 hours. The obtained toner particles are blended with external additives and are sieved in the same manner as in Example 1, whereby toner particles (4) are obtained.

The obtained toner particles (4) have a volume average particle diameter (D50) of 6.2 μm, a GSD (vol.) of 1.22, and a shape factor SF1 of 132 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 3 ppm when measured by the above-described method, the isopropyl alcohol concentration in the water dispersion supernatant liquid is 6 ppm when measured by the above-described method, and the total concentration of methyl ethyl ketone and isopropyl alcohol in the water dispersion supernatant liquid is 9 ppm. When a DMF dissolution supernatant liquid of the toner particles (4) is prepared as described above, the concentration of methyl ethyl ketone in the DMF dissolution supernatant liquid is 8 ppm, the concentration of isopropyl alcohol in the DMF dissolution supernatant liquid is 38 ppm, and the total concentration of methyl ethyl ketone and isopropyl alcohol in the DMF dissolution supernatant liquid is 46 ppm.

Toner (4) carrying external additives is prepared in the same manner as the preparation of toner (1) carrying external additives in Example 1 except that the toner particles (4) are used in place of the toner particles (1) of Example 1.

Example 5

Preparation of Toner Particles (5)

The following components are added into a 3 L reaction vessel equipped with a thermometer, a pH meter, and a stirrer:

Ion-exchanged water: 400 parts

Crystalline polyester resin dispersion liquid (1) (containing the crystalline polyester resin at a concentration of 20%): 90 parts Noncrystalline polyester resin dispersion liquid (1) (containing the noncrystalline polyester resin at a concentration of 20%): 210 parts Anionic surfactant (trade name: NEOGEN RK, manufactured by Dai-ichi Kogyo Seiyaku Co., Ltd. and having an effective component content of 60%): 2.5 parts The contents of the reaction vessel are maintained at 30° C. for 30 minutes while stirring the contents at 150 rpm and regulating the temperature from outside using a mantle heater.

Thereafter, the following components are added thereto:

Colorant Dispersion Liquid (1) (having a colorant concentration of 15%): 47 parts Releasing Agent Dispersion Liquid (having a releasing agent concentration of 25%): 32 parts The contents of the reaction vessel are maintained in the above-described temperature and stirring conditions for 5 minutes. 1.0% aqueous nitric acid solution is added thereto to adjust the pH to 2.7 while the above-described temperature and stirring conditions are maintained. Thereafter, the stirring device and the mantle heater are removed. Then, while the contents of the reaction vessel are dispersed at 3,000 rpm using a homogenizer (trade name: ULTRA-TURRAX T50, manufactured by IKA Japan K.K.), a mixture liquid of 0.5 parts of poly(aluminum chloride) and 37.5 parts of a 0.1% aqueous nitric acid solution is added thereto in the following manner: a half (in terms of weight) of the mixed liquid is added first, and then the dispersing rotation number is changed to 5,000 rpm and the other half of the mixed liquid is added over one minute, and then the dispersing rotation number is changed to 6,500 rpm and dispersing is further performed for 6 minutes.

The stirring device and the mantle heater are attached to the reaction vessel. Then, while the rotation number of the stirring device is so adjusted as to sufficiently stir the slurry, the temperature is increased to 42° C. at a rate of 0.5° C./min., maintained at 42° C. for 15 minutes, and increased at a rate of 0.1° C./min. during which the particle diameter is measured every 10 minutes with a Coulter MULTISIZER II (trade name, manufactured by Beckman Coulter Inc. and having an aperture diameter of 50 μm) at a measurement concentration of 10% using ISOTON (trade name, manufactured by Beckman Coulter Inc.) as a diluent. When the volume average particle diameter reaches 5.0 μm, 125 parts of the noncrystalline polyester resin dispersion liquid (1) are added. The temperature is maintained for 30 minutes after the addition of the noncrystalline polyester resin dispersion liquid, and then the pH of the dispersion liquid is adjusted to 9.0 using a 5% aqueous sodium hydroxide solution. Thereafter, the temperature is increased to 90° C. at a temperature increase rate of 1° C./min. while the pH is adjusted to 9.0 every time the temperature is increased by 5° C. The resultant reaction liquid is maintained at 90° C. for 2 hours, and then the temperature thereof is decreased to 20° C. at a rate of 1° C./min., thereby solidifying the particles and providing a toner particle dispersion liquid.

Thereafter, the toner particle dispersion liquid is filtrated, and then washed with running ion-exchanged water. When the conductivity of the filtrate becomes 30 mS or less, particles in the form of a cake are extracted, added to ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried using a flash dryer, wherein the dry air quantity and the hot air temperature at the inlet are regulated such that the temperature at the outlet of the flash dryer is 45° C. As a result, toner particles (5) are obtained.

The obtained toner particles (5) have a volume average particle diameter (D50) of 6.1 μm, a GSD (vol.) of 1.22, and a shape factor SF1 of 133 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 3 ppm when measured by the above-described method, the isopropyl alcohol concentration in the water dispersion supernatant liquid is 5 ppm when measured by the above-described method, and the total concentration of methyl ethyl ketone and isopropyl alcohol in the water dispersion supernatant liquid is 8 ppm. When a DMF dissolution supernatant liquid of the toner particles (5) is prepared as described above, the concentration of methyl ethyl ketone in the DMF dissolution supernatant liquid is 5 ppm, the concentration of isopropyl alcohol in the DMF dissolution supernatant liquid is 14 ppm, and the total concentration of methyl ethyl ketone and isopropyl alcohol in the DMF dissolution supernatant liquid is 19 ppm. Toner (5) carrying external additives is prepared in the same manner as the preparation of toner (1) carrying external additives in Example 1 except that the toner particles (5) are used in place of the toner particles (1) of Example 1.

Example 6

Preparation of Toner Particles (6)

Toner particles (6) are prepared in the same manner as the preparation of toner particles (1) in Example 1 except that the crystalline polyester resin dispersion liquid (7) and the noncrystalline polyester resin dispersion liquid (9) are used in place of the crystalline polyester resin dispersion liquid (1) and the noncrystalline polyester resin dispersion liquid (1), respectively, of Example 1.

The obtained toner particles (6) have a volume average particle diameter (D50) of 6.4 μm, a GSD (vol.) of 1.23, and a shape factor SF1 of 135 as determined by observation of the particle shape under a LUZEX FT (trade name, manufactured by Nireco Corporation). When a water dispersion supernatant liquid of the toner is prepared as described above the acetone concentration in the water dispersion supernatant liquid is 3 ppm when measured by the above-described method, the isopropyl alcohol concentration in the water dispersion supernatant liquid is 4 ppm when measured by the above-described method, and the total concentration of acetone and isopropyl alcohol in the water dispersion supernatant liquid is 7 ppm. When a DMF dissolution supernatant liquid of the toner particles (6) is prepared as described above, the concentration of acetone in the DMF dissolution supernatant liquid is 5 ppm, the concentration of isopropyl alcohol in the DMF dissolution supernatant liquid is 20 ppm, and the total concentration of acetone and isopropyl alcohol in the DMF dissolution supernatant liquid is 25 ppm.

Toner (6) carrying external additives is prepared in the same manner as the preparation of toner (1) carrying external additives in Example 1 except that the toner particles (6) are used in place of the toner particles (1) of Example 1.

Example 7

Preparation of Toner Particles (7)

Toner particles (7) are prepared in the same manner as the preparation of toner particles (1) in Example 1 except that the crystalline polyester resin dispersion liquid (8) and the noncrystalline polyester resin dispersion liquid (10) are used in place of the crystalline polyester resin dispersion liquid (1) and the noncrystalline polyester resin dispersion liquid (1), respectively, of Example 1.

The obtained toner particles (7) have a volume average particle diameter (D50) of 5.9 μm, a GSD (vol.) of 1.21, and a shape factor SF1 of 131 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 2 ppm when measured by the above-described method, the ethanol concentration in the water dispersion supernatant liquid is 6 ppm when measured by the above-described method, and the total concentration of methyl ethyl ketone and ethanol in the water dispersion supernatant liquid is 8 ppm. When a DMF dissolution supernatant liquid of the toner particles (7) is prepared as described above, the concentration of methyl ethyl ketone in the DMF dissolution supernatant liquid is 6 ppm, the concentration of ethanol in the DMF dissolution supernatant liquid is 17 ppm, and the total concentration of methyl ethyl ketone and ethanol in the DMF dissolution supernatant liquid is 23 ppm.

Toner (7) carrying external additives is prepared in the same manner as the preparation of toner (1) carrying external additives in Example 1 except that the toner particles (7) are used in place of the toner particles (1) of Example 1.

Comparative Example 1

Preparation of Toner Particles (8)

Toner particles (8) are prepared in the same manner as the preparation of toner particles (1) in Example 1 except that the crystalline polyester resin dispersion liquid (5) and the noncrystalline polyester resin dispersion liquid (5) are used in place of the crystalline polyester resin dispersion liquid (1) and the noncrystalline polyester resin dispersion liquid (1), respectively, of Example 1.

The obtained toner particles (8) have a volume average particle diameter (D50) of 6.2 μm, a GSD (vol.) of 1.22, and a shape factor SF1 of 132 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 0 ppm when measured by the above-described method, the isopropyl alcohol concentration in the water dispersion supernatant liquid is 0 ppm when measured by the above-described method, and the total concentration of methyl ethyl ketone and isopropyl alcohol in the water dispersion supernatant liquid is 0 ppm. When a DMF dissolution supernatant liquid of the toner particles (8) is prepared as described above, the concentration of methyl ethyl ketone in the DMF dissolution supernatant liquid is 0 ppm, the concentration of isopropyl alcohol in the DMF dissolution supernatant liquid is 0 ppm, and the total concentration of methyl ethyl ketone and isopropyl alcohol in the DMF dissolution supernatant liquid is 0 ppm.

Toner (8) carrying external additives is prepared in the same manner as the preparation of toner (1) carrying external additives in Example 1 except that the toner particles (8) are used in place of the toner particles (1) of Example 1.

Comparative Example 2

Preparation of Toner Particles (9)

Toner particles (9) are prepared in the same manner as the preparation of toner particles (1) in Example 1 except that the crystalline polyester resin dispersion liquid (6) and the noncrystalline polyester resin dispersion liquid (6) are used in place of the crystalline polyester resin dispersion liquid (1) and the noncrystalline polyester resin dispersion liquid (1), respectively, of Example 1.

The obtained toner particles (9) have a volume average particle diameter (D50) of 6.3 μm, a GSD (vol.) of 1.22, and a shape factor SF1 of 130 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 50 ppm when measured by the above-described method, the isopropyl alcohol concentration in the water dispersion supernatant liquid is 100 ppm when measured by the above-described method, and the total concentration of methyl ethyl ketone and isopropyl alcohol in the water dispersion supernatant liquid is 150 ppm. When a DMF dissolution supernatant liquid of the toner particles (9) is prepared as described above, the concentration of methyl ethyl ketone in the DMF dissolution supernatant liquid is 300 ppm, the concentration of isopropyl alcohol in the DMF dissolution supernatant liquid is 160 ppm, and the total concentration of methyl ethyl ketone and isopropyl alcohol in the DMF dissolution supernatant liquid is 460 ppm.

Toner (9) carrying external additives is prepared in the same manner as the preparation of toner (1) carrying external additives in Example 1 except that the toner particles (9) are used in place of the toner particles (1) of Example 1.

Comparative Example 3

Preparation of Toner Particles (10)

Toner particles (10) are prepared in the same manner as the preparation of toner particles (1) in Example 1 except that the crystalline polyester resin dispersion liquid (4) and the noncrystalline polyester resin dispersion liquid (4) are used in place of the crystalline polyester resin dispersion liquid (1) and the noncrystalline polyester resin dispersion liquid (1), respectively, of Example 1.

The obtained toner particles (10) have a volume average particle diameter (D50) of 6.3 μm, a GSD (vol.) of 1.23, and a shape factor SF1 of 132 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 0 ppm when measured by the above-described method, the isopropyl alcohol concentration in the water dispersion supernatant liquid is 2 ppm when measured by the above-described method, and the total concentration of methyl ethyl ketone and isopropyl alcohol in the water dispersion supernatant liquid is 2 ppm. When a DMF dissolution supernatant liquid of the toner particles (10) is prepared as described above, the concentration of methyl ethyl ketone in the DMF dissolution supernatant liquid is 0 ppm, the concentration of isopropyl alcohol in the DMF dissolution supernatant liquid is 4 ppm, and the total concentration of methyl ethyl ketone and isopropyl alcohol in the DMF dissolution supernatant liquid is 4 ppm.

Toner (10) carrying external additives is prepared in the same manner as the preparation of toner (1) carrying external additives in Example 1 except that the toner particles (10) are used in place of the toner particles (1) of Example 1.

Comparative Example 4

Preparation of Toner Particles (11)

Toner particles (11) are prepared in the same manner as the preparation of toner particles (1) in Example 1 except that the crystalline polyester resin dispersion liquid (5) and the noncrystalline polyester resin dispersion liquid (8) are used in place of the crystalline polyester resin dispersion liquid (1) and the noncrystalline polyester resin dispersion liquid (1), respectively, of Example 1.

The obtained toner particles (11) have a volume average particle diameter (D50) of 6.4 μm, a GSD (vol.) of 1.23, and a shape factor SF1 of 131 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 0 ppm when measured by the above-described method, the isopropyl alcohol concentration in the water dispersion supernatant liquid is 20 ppm when measured by the above-described method, and the total concentration of methyl ethyl ketone and isopropyl alcohol in the water dispersion supernatant liquid is 20 ppm. When a DMF dissolution supernatant liquid of the toner particles (11) is prepared as described above, the concentration of methyl ethyl ketone in the DMF dissolution supernatant liquid is 0 ppm, the concentration of isopropyl alcohol in the DMF dissolution supernatant liquid is 35 ppm, and the total concentration of methyl ethyl ketone and isopropyl alcohol in the DMF dissolution supernatant liquid is 35 ppm.

Toner (11) carrying external additives is prepared in the same manner as the preparation of toner (1) carrying external additives in Example 1 except that the toner particles (11) are used in place of the toner particles (1) of Example 1.

Comparative Example 5

Preparation of Toner Particles (12)

Toner particles (12) are prepared in the same manner as the preparation of toner particles (1) in Example 1 except that the crystalline polyester resin dispersion liquid (5) and the noncrystalline polyester resin dispersion liquid (7) are used in place of the crystalline polyester resin dispersion liquid (1) and the noncrystalline polyester resin dispersion liquid (1), respectively, of Example 1.

The obtained toner particles (12) have a volume average particle diameter (D50) of 6.2 μm, a GSD (vol.) of 1.24, and a shape factor SF1 of 129 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 5 ppm when measured by the above-described method, the isopropyl alcohol concentration in the water dispersion supernatant liquid is 0 ppm when measured by the above-described method, and the total concentration of methyl ethyl ketone and isopropyl alcohol in the water dispersion supernatant liquid is 5 ppm. When a DMF dissolution supernatant liquid of the toner particles (12) is prepared as described above, the concentration of methyl ethyl ketone in the DMF dissolution supernatant liquid is 9 ppm, the concentration of isopropyl alcohol in the DMF dissolution supernatant liquid is 0 ppm, and the total concentration of methyl ethyl ketone and isopropyl alcohol in the DMF dissolution supernatant liquid is 9 ppm.

Toner (12) carrying external additives is prepared in the same manner as the preparation of toner (1) carrying external additives in Example 1 except that the toner particles (12) are used in place of the toner particles (1) of Example 1.

Comparative Example 6

Preparation of Toner Particles (13)

A toner particle dispersion liquid is prepared using the same materials and in the same manner as in Comparative Example 5. Thereafter, the toner particle dispersion liquid is filtrated, and then washed with running ion-exchanged water.

When the conductivity of the filtrate becomes 30 mS or less, particles in the form of a cake are extracted, added to ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried in an oven at 25° C. for 24 hours.

The dried particles are pulverized with a sample mill, and are dried again in an oven at 25° C. for 24 hours. The obtained toner particles are blended with external additives and are sieved in the same manner as in Example 1, whereby toner particles (13) are obtained.

The obtained toner particles (13) have a volume average particle diameter (D50) of 6.1 μm, a GSD (vol.) of 1.24, and a shape factor SF1 of 130 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 15 ppm when measured by the above-described method, the isopropyl alcohol concentration in the water dispersion supernatant liquid is 0 ppm when measured by the above-described method, and the total concentration of methyl ethyl ketone and isopropyl alcohol in the water dispersion supernatant liquid is 15 ppm. When a DMF dissolution supernatant liquid of the toner particles (13) is prepared as described above, the concentration of methyl ethyl ketone in the DMF dissolution supernatant liquid is 30 ppm, the concentration of isopropyl alcohol in the DMF dissolution supernatant liquid is 0 ppm, and the total concentration of methyl ethyl ketone and isopropyl alcohol in the DMF dissolution supernatant liquid is 30 ppm.

Toner (13) carrying external additives is prepared in the same manner as the preparation of toner (1) carrying external additives in Example 1 except that the toner particles (13) are used in place of the toner particles (1) of Example 1.

Comparative Example 7

Preparation of Toner Particles (14)

A toner particle dispersion liquid is prepared using the same materials and in the same manner as in Comparative Example 4. Thereafter, the toner particle dispersion liquid is filtrated, and then washed with running ion-exchanged water. When the conductivity of the filtrate becomes 30 mS or less, particles in the form of a cake are extracted, added into ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried in an oven at 25° C. for 24 hours. The dried particles are pulverized with a sample mill, and are dried again in an oven at 25° C. for 24 hours. The obtained toner particles are blended with external additives and are sieved in the same manner as in Example 1, whereby toner particles (14) are obtained.

The obtained toner particles (143) have a volume average particle diameter (D50) of 6.0 μm, a GSD (vol.) of 1.23, and a shape factor SF1 of 133 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 0 ppm when measured by the above-described method, the isopropyl alcohol concentration in the water dispersion supernatant liquid is 30 ppm when measured by the above-described method, and the total concentration of methyl ethyl ketone and isopropyl alcohol in the water dispersion supernatant liquid is 30 ppm. When a DMF dissolution supernatant liquid of the toner particles (14) is prepared as described above, the concentration of methyl ethyl ketone in the DMF dissolution supernatant liquid is 0 ppm, the concentration of isopropyl alcohol in the DMF dissolution supernatant liquid is 52 ppm, and the total concentration of methyl ethyl ketone and isopropyl alcohol in the DMF dissolution supernatant liquid is 52 ppm.

Toner (14) carrying external additives is prepared in the same manner as the preparation of toner (1) carrying external additives in Example 1 except that the toner particles (14) are used in place of the toner particles (1) of Example 1.

Comparative Example 8

Preparation of Toner Particles (15)

The following components are added into a 3 L reaction vessel equipped with a thermometer a pH meter, and a stirrer:

Ion-exchanged water: 400 parts

Crystalline polyester resin dispersion liquid (1) (containing the crystalline polyester resin at a concentration of 20%): 175 parts Noncrystalline polyester resin dispersion liquid (1) (containing the noncrystalline polyester resin at a concentration of 20%): 125 parts Anionic surfactant (trade name: NEOGEN RK, manufactured by Dai-ichi Kogyo Seiyaku Co., Ltd. and having an effective component content of 60%): 2.5 parts The contents of the reaction vessel are maintained at 30° C. for 30 minutes while stirring the contents at 150 rpm and regulating the temperature from outside using a mantle heater.

Thereafter, the following components are added thereto:

Colorant Dispersion Liquid (1) (having a colorant concentration of 15%): 47 parts Releasing Agent Dispersion Liquid (having a releasing agent concentration of 25%): 32 parts The contents of the reaction vessel are maintained in the above-described temperature and stirring conditions for 5 minutes. 1.0% aqueous nitric acid solution is added thereto to adjust the pH to 2.7 while the above-described temperature and stirring conditions are maintained. Thereafter, the stirring device and the mantle heater are removed. Then, while the contents of the reaction vessel are dispersed at 3,000 rpm using a homogenizer (trade name: ULTRA-TURRAX T50, manufactured by IKA Japan K.K.), a mixture liquid of 0.5 parts of poly(aluminum chloride) and 37.5 parts of a 0.1% aqueous nitric acid solution is added thereto in the following manner: a half (in terms of weight) of the mixed liquid is added first, and then the dispersing rotation number is changed to 5,000 rpm and the other half of the mixed liquid is added over one minute, and then the dispersing rotation number is changed to 6,500 rpm and dispersing is further performed for 6 minutes.

The stirring device and the mantle heater are attached to the reaction vessel. Then, while the rotation number of the stirring device is so adjusted as to sufficiently stir the slurry, the temperature is increased to 42° C. at a rate of 0.5° C./min., maintained at 42° C. for 15 minutes, and increased at a rate of 0.1° C./min. during which the particle diameter is measured every 10 minutes with a Coulter MULTISIZER II (trade name, manufactured by Beckman Coulter Inc. and having an aperture diameter of 50 μm) at a measurement concentration of 10% using ISOTON (trade name, manufactured by Beckman Coulter Inc.) as a diluent. When the volume average particle diameter reaches 5.0 μm, 125 parts of the noncrystalline polyester resin dispersion liquid (1) are added. The temperature is maintained for 30 minutes after the addition of the noncrystalline polyester resin dispersion liquid, and then the pH of the dispersion liquid is adjusted to 9.0 using a 5% aqueous sodium hydroxide solution. Thereafter, the temperature is increased to 90° C. at a temperature increase rate of 1° C./min. while the pH is adjusted to 9.0 every time the temperature is increased by 5° C. The resultant reaction liquid is maintained at 90° C. for 2 hours, and then the temperature thereof is decreased to 20° C. at a rate of 1° C./min., thereby solidifying the particles and providing a toner particle dispersion liquid.

Thereafter, the toner particle dispersion liquid is filtrated, and then washed with running ion-exchanged water. When the conductivity of the filtrate becomes 30 mS or less, the particles in the form of a cake are extracted, added to ion-exchanged water in an amount having a weight that is 10 times that of the particles, and stirred with a three-one motor When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried using a flash dryer, wherein the dry air quantity and the hot air temperature at the inlet are regulated such that the temperature at the outlet of the flash dryer is 38° C. As a result, toner particles (15) are obtained.

The obtained toner particles (15) have a volume average particle diameter (D50) of 6.1 μm, a GSD (vol.) of 1.22, and a shape factor SF1 of 132 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 1 ppm when measured by the above-described method, the isopropyl alcohol concentration in the water dispersion supernatant liquid is 12 ppm when measured by the above-described method, and the total concentration of methyl ethyl ketone and isopropyl alcohol in the water dispersion supernatant liquid is 13 ppm. When a DMF dissolution supernatant liquid of the toner particle (15) is prepared as described above, the concentration of methyl ethyl ketone in the DMF dissolution supernatant liquid is 5 ppm, the concentration of isopropyl alcohol in the DMF dissolution supernatant liquid is 14 ppm, and the total concentration of methyl ethyl ketone and isopropyl alcohol in the DMF dissolution supernatant liquid is 19 ppm. Toner (15) carrying external additives is prepared in the same manner as the preparation of toner (1) carrying external additives in Example 1 except that the toner particles (15) are used in place of the toner particles (1) of Example 1.

Comparative Example 9

Preparation of Toner Particles (16)

The following components are added into a 3 L reaction vessel equipped with a thermometer, a pH meter, and a stirrer:

Ion-exchanged water: 400 parts

Noncrystalline polyester resin dispersion liquid (6) (containing the noncrystalline polyester resin at a concentration of 20%): 300 parts Anionic surfactant (trade name: NEOGEN RK, manufactured by Dai-ichi Kogyo Seiyaku Co., Ltd. and having an effective component content of 60%): 2.5 parts The contents of the reaction vessel are maintained at 30° C. for 30 minutes while stirring the contents at 150 rpm and regulating the temperature from outside using a mantle heater.

Thereafter, the following components are added thereto:

Colorant Dispersion Liquid (1) (having a colorant concentration of 15%): 47 parts Releasing Agent Dispersion Liquid (having a releasing agent concentration of 25%): 32 parts The contents of the reaction vessel are maintained in the above-described temperature and stirring conditions for 5 minutes. 1.0% aqueous nitric acid solution is added thereto to adjust the pH to 2.7 while the above-described temperature and stirring conditions are maintained. Thereafter, the stirring device and the mantle heater are removed. Then, while the contents of the reaction vessel are dispersed at 3,000 rpm using a homogenizer (trade name: ULTRA-TURRAX T50, manufactured by IKA Japan K.K.), a mixture liquid of 0.5 parts of poly(aluminum chloride) and 37.5 parts of a 0.1% aqueous nitric acid solution is added thereto in the following manner: a half (in terms of weight) of the mixed liquid is added first, and then the dispersing rotation number is changed to 5,000 rpm and the other half of the mixed liquid is added over one minute, and then the dispersing rotation number is changed to 6,500 rpm and dispersing is further performed for 6 minutes.

The stirring device and the mantle heater are attached to the reaction vessel. Then, while the rotation number of the stirring device is so adjusted as to sufficiently stir the slurry, the temperature is increased to 42° C. at a rate of 0.5° C./min., maintained at 42° C. for 15 minutes, and increased at a rate of 0.1° C./min. during which the particle diameter is measured every 10 minutes with a Coulter MULTISIZER II (trade name, manufactured by Beckman Coulter Inc. and having an aperture diameter of 50 μm) at a measurement concentration of 10% using ISOTON (trade name, manufactured by Beckman Coulter Inc.) as a diluent. When the volume average particle diameter reaches 5.0 μm, 125 parts of the noncrystalline polyester resin dispersion liquid (1) are added. The temperature is maintained for 30 minutes after the addition of the noncrystalline polyester resin dispersion liquid, and then the pH of the dispersion liquid is adjusted to 9.0 using a 5% aqueous sodium hydroxide solution. Thereafter, the temperature is increased to 90° C. at a temperature increase rate of 1° C./min. while the pH is adjusted to 9.0 every time the temperature is increased by 5° C. The resultant reaction liquid is maintained at 90° C. for 2 hours, and then the temperature thereof is decreased to 20° C. at a rate of 1° C./min., thereby solidifying the particles and providing a toner particle dispersion liquid.

Thereafter, the toner particle dispersion liquid is filtrated, and then washed with running ion-exchanged water. When the conductivity of the filtrate becomes 30 mS or less, particles in the form of a cake are extracted, added to ion-exchanged water in an amount having a weight that is 10 times that of the particles, and stirred with a three-one motor. When the particles are sufficiently dispersed, the pH of the liquid is adjusted to 4.0 using a 1.0% aqueous nitric acid solution, and is maintained for 10 minutes. Thereafter, filtration and washing with running water are performed again. When the conductivity of the filtrate becomes 10 mS or less, the washing with running water is stopped, thereby allowing solid-liquid separation. The obtained particles in the form of a cake are pulverized with a sample mill, and are dried using a flash dryer, wherein the dry air quantity and the hot air temperature at the inlet are regulated such that the temperature at the outlet of the flash dryer is 45° C. As a result, toner particles (16) are obtained.

described above, the concentration of methyl ethyl ketone in the DMF dissolution supernatant liquid is 3 ppm, the concentration of isopropyl alcohol in the DMF dissolution supernatant liquid is 56 ppm, and the total concentration of methyl ethyl ketone and isopropyl alcohol in the DMF dissolution supernatant liquid is 59 ppm. Toner (16) carrying external additives is prepared in the same manner as the preparation of toner (1) carrying external additives in Example 1 except that the toner particles (16) are used in place of the toner particles (1) of Example 1.

The properties of the toner (the toner particles) obtained in Examples 1 to 7 and Comparative Examples 1 to 9 are shown in Table 1.

TABLE 1

| | | Non-crystalline | Crystalline | | | | Concentration of Solvents in Water Dispersion Supernatant Liquid | | | Concentration of Solvents in DMF Dissolution Supernatant Liquid | | |
|---|---|---|---|---|---|---|---|---|---|---|---|---|
| | Toner (Toner particle No.) | Polyester Resin Particle Dispersion Liquid No. | Polyester Resin Particle Dispersion Liquid No. | D50v of Toner (μm) | GSDv of Toner | SF1 | Ketone Solvent (ppm) | Alcoholic Solvent (ppm) | Total Concentration of Ketone Solvent and Alcoholic Solvent (ppm) | Ketone Solvent (ppm) | Alcoholic Solvent (ppm) | Total Concentration of Ketone Solvent and Alcoholic Solvent (ppm) |
| Example 1 | (1) | (1) | (1) | 6.2 | 1.22 | 133 | 2 (MEK) | 7 (IPA) | 9 | 6 (MEK) | 15 (IPA) | 21 |
| Example 2 | (2) | (2) | (2) | 6.3 | 1.23 | 128 | 5 (MEK) | 3 (IPA) | 8 | 15 (MEK) | 8 (IPA) | 23 |
| Example 3 | (3) | (3) | (3) | 5.8 | 1.24 | 133 | 1 (MEK) | 5 (IPA) | 6 | 3 (MEK) | 8 (IPA) | 11 |
| Example 4 | (4) | (6) | (6) | 6.2 | 1.22 | 132 | 3 (MEK) | 6 (IPA) | 9 | 8 (MEK) | 38 (IPA) | 46 |
| Example 5 | (5) | (1) | (1) | 6.1 | 1.22 | 133 | 3 (MEK) | 5 (IPA) | 8 | 5 (MEK) | 14 (IPA) | 19 |
| Example 6 | (6) | (9) | (7) | 6.4 | 1.23 | 135 | 3 (Acetone) | 4 (IPA) | 7 | 5 (Acetone) | 20 (IPA) | 25 |
| Example 7 | (7) | (10) | (8) | 5.9 | 1.21 | 131 | 2 (MEK) | 6 (Ethanol) | 8 | 6 (MEK) | 17 (Ethanol) | 23 |
| Comp. Ex. 1 | (8) | (5) | (5) | 6.2 | 1.22 | 132 | 0 | 0 | 0 | 0 | 0 | 0 |
| Comp. Ex. 2 | (9) | (6) | (6) | 6.3 | 1.22 | 130 | 50 (MEK) | 100 (IPA) | 150 | 300 (MEK) | 160 (IPA) | 460 |
| Comp. Ex. 3 | (10) | (4) | (4) | 6.3 | 1.23 | 132 | 0 | 2 (IPA) | 2 | 0 | 4 (IPA) | 4 |
| Comp. Ex. 4 | (11) | (8) | (5) | 6.4 | 1.23 | 131 | 0 | 20 (IPA) | 20 | 0 | 35 (IPA) | 35 |
| Comp. Ex. 5 | (12) | (7) | (5) | 6.2 | 1.24 | 129 | 5 (MEK) | 0 | 5 | 9 (MEK) | 0 | 9 |
| Comp. Ex. 6 | (13) | (7) | (5) | 6.1 | 1.24 | 130 | 15 (MEK) | 0 | 15 | 30 (MEK) | 0 | 30 |
| Comp. Ex. 7 | (14) | (8) | (5) | 6.0 | 1.23 | 133 | 0 | 30 (IPA) | 30 | 0 | 52 (IPA) | 52 |
| Comp. Ex. 8 | (15) | (1) | (1) | 6.1 | 1.22 | 132 | 1 (MEK) | 12 (IPA) | 13 | 5 (MEK) | 14 (IPA) | 19 |
| Comp. Ex. 9 | (16) | (6) | Not Added | 6.2 | 1.24 | 132 | 2 (MEK) | 2 (IPA) | 4 | 3 (MEK) | 56 (IPA) | 59 |

The obtained toner particles (16) have a volume average particle diameter (D50) of 6.2 μm, a GSD (vol.) of 1.24, and a shape factor SF1 of 132 as determined by observation of the particle shape under a LUZEX FT (trade name, manufactured by Nireco Corporation). When a water dispersion supernatant liquid of the toner is prepared as described above, the methyl ethyl ketone concentration in the water dispersion supernatant liquid is 2 ppm when measured by the above-described method, the isopropyl alcohol concentration in the water dispersion supernatant liquid is 2 ppm when measured by the above-described method, and the total concentration of methyl ethyl ketone and isopropyl alcohol in the water dispersion supernatant liquid is 4 ppm. When a DMF dissolution supernatant liquid of the toner particle (16) is prepared as Production of Carrier The following components, except the ferrite particles, are stirred in a sand mill for 10 minutes, and the quantity of the resultant dispersion liquid for coating is measured:

Ferrite particles having a volume average particle diameter of 35 μm: 100 parts

Toluene: 14 parts

Copolymer of styrene and methyl methacrylate in a copolymerization ratio (styrene/methyl methacrylate) of 30/70: 2 parts Carbon Black (trade name: VXC72, manufactured by Cabot Corporation): 0.15 parts The obtained dispersion liquid for coating and the ferrite particles are added into a vacuum deaeration kneader, and mixed at 60° C. at a reduced pressure of (atmospheric pressure −20 mmHg) for 30 minutes while stirring, and then the temperature is increased to 90° C. and the pressure is reduced to (atmospheric pressure −720 mmHg). The contents in the vacuum deaeration kneader are dried by being stirred at 90° C. and (atmospheric pressure −720 mmHg) for 30 minutes, whereby a carrier is obtained. The carrier has a volume resistivity of $10^{12}$ Ω·cm at an applied electric field of 1,000 V/cm.

Production of Developers (1) to (16)

8 parts of the toner (1) obtained in Example 1 are added to 100 parts of the carrier obtained above. The toner (1) and the carrier are blended for 20 minutes using a V-blender, and coarse aggregates are removed by a vibrating sieve having a mesh of 212 μm, whereby developer (1) is obtained. Developers (2) to (16) are obtained in the same manner as the production of developer (1), except that the toner (1) is replaced by the toners (2) to (16), respectively.

Evaluation

Evaluation of Image Foldability

Each of the developers (1) to (16) obtained in Examples 1 to 7 and Comparative Examples 1 to 9 is evaluated as follows. A solid image is printed on plain paper (metric basis weight: 82 g/m$^2$) at each of varied printing speeds of 55 mm/s, 160 mm/s, and 220 mm/s, using the developer and a modified machine of a DOCU CENTRE COLOR400 CP (trade name, manufactured by Fuji Xerox Co., Ltd.) with a fuser roller temperature of 180° C. and a toner weight per unit area of 15 mg/cm$^2$. The printed solid image is folded inwardly by applying a load of 40 g/cm$^2$ for 30 seconds, and unfolded. Damaged image portions are removed by being rubbed with a soft cloth, and the maximum width of the image defect after the rubbing is assumed to be the value of image foldability. The results are shown in Table 2. Although the foldability is preferably such that no image defect occurs, a value of about 0.5 mm is practically non-problematic. Considering such an acceptable range, in Table 2, "A" represents foldability whereby the maximum width of the image defect is 0.4 mm or less, "B" represents foldability whereby the maximum width of the image defect is from more than 0.4 mm to 0.7 mm, and "C" represents foldability whereby the maximum width of the image defect is more than 0.7 mm.

Evaluation of Tendency Toward Blocking

Each of the toners (1) to (16) obtained in Examples 1 to 7 and Comparative Examples 1 to 9 is left to stand in an environment of 25° C. and 50% RH for about 24 hours, and evaluated with respect to tendency toward blocking under the following conditions. The toner sample after the standing in an environment of 25° C. and 50% RH for about 24 hours is placed onto a 53 μm-mesh sieve of a toner powder tester (manufactured by Hosokawa Micron Corporation) having the 53 μm-mesh sieve, a 45 μm-mesh sieve, and a 38 μm-mesh sieve that are disposed in series in this order from the upper level. Vibration having an amplitude of 1 mm is applied to the sieves of the toner powder tester for 90 seconds, the weight of the toner on each sieve is measured after the application of the vibration, the measured toner weights on the 53 μm-mesh, 45 μm-mesh, and 38 μm-mesh sieves are weighted by factors of 0.5, 0.3, and 0.1, respectively, the weighted toner weights are summed up and divided by the toner sample weight originally placed onto the toner powder tester and the resulting quotient is expressed by percentage. The results are shown in Table 2. When the percentage is 30% or less, the tendency toward blocking is practically non-problematic. The percentage is preferably 20% or less, and more preferably 10% or less. Considering the above, in Table 2, "A" indicates that the percentage is 20% or less, "B" indicates that the percentage is more than 20% to 30%, and "C" indicates that the percentage is over 30%.

TABLE 2

| | Foldability | | | | | | | |
|---|---|---|---|---|---|---|---|---|
| | Fixing Speed = 55 mm/s | | Fixing Speed = 160 mm/s | | Fixing Speed = 220 mm/s | | Tendency toward Blocking | |
| Example 1 | 0.0 mm | A | 0.1 mm | A | 0.1 mm | A | 8% | A |
| Example 2 | 0.1 mm | A | 0.1 mm | A | 0.2 mm | A | 7% | A |
| Example 3 | 0.0 mm | A | 0.3 mm | A | 0.4 mm | A | 10% | A |
| Example 4 | 0.0 mm | A | 0.2 mm | A | 0.1 mm | A | 14% | A |
| Example 5 | 0.0 mm | A | 0.0 mm | A | 0.1 mm | A | 20% | A |
| Example 6 | 0.0 mm | A | 0.2 mm | A | 0.3 mm | A | 12% | A |
| Example 7 | 0.2 mm | A | 0.3 mm | A | 0.2 mm | A | 20% | A |
| Comparative Example 1 | 0.5 mm | B | 0.6 mm | B | 0.8 mm | C | 30% | B |
| Comparative Example 2 | 0.1 mm | A | 0.2 mm | A | 0.2 mm | A | 70% | C |
| Comparative Example 3 | 0.7 mm | B | 0.8 mm | C | 1.2 mm | C | 40% | C |
| Comparative Example 4 | 0.8 mm | C | 1.2 mm | C | 1.5 mm | C | 20% | A |
| Comparative Example 5 | 0.8 mm | C | 1.0 mm | C | 1.3 mm | C | 18% | A |
| Comparative Example 6 | 0.3 mm | A | 0.5 mm | B | 0.6 mm | B | 40% | C |
| Comparative Example 7 | 0.4 mm | A | 0.8 mm | C | 1.3 mm | C | 15% | A |
| Comparative Example 8 | 0.7 mm | B | 0.9 mm | C | 1.3 mm | C | 20% | A |
| Comparative Example 9 | 1.2 mm | C | 1.5 mm | C | 2.0 mm | C | 55% | C |

As shown in Table 2, in Examples 1 to 7, foldability of an image is excellent regardless of the fixing speed, and resistance to blocking of the toner is also excellent. In contrast, the toners used in Comparative Examples 1 to 9 produce practical problems in, for example, inferior foldability of an image and/or inferior resistance to blocking of the toner observed even in samples that show satisfactory foldability of an image.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic charge image, the toner comprising a binder resin containing a crystalline polyester resin and a noncrystalline polyester resin, a colorant, a releasing agent, a ketone solvent, and an alcoholic solvent, the total concentration of the ketone solvent and the alcoholic solvent in a first toner dispersion liquid being less than about 10 ppm when 0.5 g of the toner is dispersed in 2 g of deionized water to form the first toner dispersion liquid, and the total concentration of the ketone solvent in a second toner dispersion liquid being from about 1 ppm to about 8 ppm, and the total concentration of the ketone solvent and the alcoholic solvent in the second toner dispersion liquid being from about 2 ppm to about 50 ppm, when 0.5 g of the toner is dispersed in 2 g of N,N-dimethylformamide to form the second toner dispersion liquid, wherein the first and second toner dispersion liquids are left to stand at 20° C. for 24 hours.

2. The toner for developing an electrostatic charge image of claim 1, wherein the concentration of the alcoholic solvent in the second toner dispersion liquid is from about 1 ppm to about 49 ppm.

3. The toner for developing an electrostatic charge image of claim 1, wherein the content of the crystalline polyester resin with respect to the total amount of the binder resin is from about 1% by weight to about 20% by weight.

4. The toner for developing an electrostatic charge image of claim 1, wherein the ketone solvent is selected from the group consisting of acetone, methyl ethyl ketone, and diethyl ketone.

5. The toner for developing an electrostatic charge image of claim 1, wherein the ketone solvent is methyl ethyl ketone.

6. The toner for developing an electrostatic charge image of claim 1, wherein the alcoholic solvent is selected from the group consisting of methanol, ethanol, propanol, isopropanol, and butanol.

7. The toner for developing an electrostatic charge image of claim 1, wherein the alcoholic solvent is isopropanol.

8. The toner for developing an electrostatic charge image of claim 1, wherein the ketone solvent is methyl ethyl ketone or acetone and the alcoholic solvent is isopropanol or ethanol.

9. A developer for developing an electrostatic charge image, the developer comprising the toner for developing an electrostatic charge image of claim 1.

10. The toner for developing an electrostatic charge image of claim 1, wherein the ketone solvent is acetone or methyl ethyl ketone.

* * * * *